US009066545B2

(12) United States Patent
Klug et al.

(10) Patent No.: US 9,066,545 B2
(45) Date of Patent: Jun. 30, 2015

(54) PIECE OF GARMENT

(75) Inventors: Helmut Klug, Poing (DE); Mandy Gorlt, Grosshoehenrain (DE)

(73) Assignee: W. L. GORE & ASSOCIATES, GmbH, Putzbrunn (DE)

( * ) Notice: Subject to any disclaimer, the term of this patent is extended or adjusted under 35 U.S.C. 154(b) by 1462 days.

(21) Appl. No.: 11/911,839

(22) PCT Filed: Apr. 24, 2006

(86) PCT No.: PCT/EP2006/003751
§ 371 (c)(1),
(2), (4) Date: May 5, 2009

(87) PCT Pub. No.: WO2006/117094
PCT Pub. Date: Nov. 9, 2006

(65) Prior Publication Data

US 2009/0222980 A1 Sep. 10, 2009

(30) Foreign Application Priority Data

Apr. 29, 2005 (DE) ..... 10 2005 020 076

(51) Int. Cl.
*A41D 19/015* (2006.01)
*A41D 19/00* (2006.01)

(52) U.S. Cl.
CPC ..... *A41D 19/01529* (2013.01); *A41D 19/001* (2013.01)

(58) Field of Classification Search
CPC ..... A41D 19/01529; A41D 19/001
USPC ..... 2/16, 20, 161.1, 161.6, 163
See application file for complete search history.

(56) References Cited

U.S. PATENT DOCUMENTS

| | | | | |
|---|---|---|---|---|
| 2,675,798 | A | | 4/1954 | Rosmarin |
| 2,782,912 | A | | 2/1957 | Humphrey |
| 2,792,827 | A | * | 5/1957 | Gravin et al. ..... 126/204 |
| 2,840,823 | A | | 7/1958 | Kita |
| 3,953,566 | A | | 4/1976 | Gore |
| 4,187,390 | A | | 2/1980 | Gore |
| 4,194,041 | A | | 3/1980 | Gore |
| 4,230,838 | A | | 10/1980 | Foy et al. |
| 4,493,870 | A | | 1/1985 | Vrouenraets et al. |

(Continued)

FOREIGN PATENT DOCUMENTS

| | | |
|---|---|---|
| BE | 488 992 | 5/1949 |
| EP | 1 514 484 | 3/2005 |
| FR | 2 465 429 | 3/1981 |

*Primary Examiner* — Katherine Morgan
(74) *Attorney, Agent, or Firm* — Amy L. Miller

(57) ABSTRACT

Disclosed is a piece of garment, e.g. in the form of a glove, comprising an outer layer that encloses at least one interior space which is provided with an opening for accommodating a body part such as a hand and is subdivided into at least two adjoining chambers. Each chamber encompasses at least one chamber opening that is arranged in the opening of the interior space and selectively accommodates the body part such as a hand. The material of each chamber can be constructed with at least one layer of protective material which can be provided with an insulating material, a functional layer material, a cut-resistant material, a heat-resistant and/or a flameproof material, for example. The inventive design allows the user of the glove to selectively put his/her hand into one of the chambers that are provided, according to the desired protective effect, while the unused chamber lies in the interior space in a compressed manner.

51 Claims, 12 Drawing Sheets

(56) References Cited

U.S. PATENT DOCUMENTS

| | | | | |
|---|---|---|---|---|
| 4,532,316 | A | | 7/1985 | Henn |
| 4,662,006 | A | | 5/1987 | Ross, Jr. |
| 4,725,481 | A | | 2/1988 | Ostapchenko |
| 4,759,084 | A | | 7/1988 | Madnick et al. |
| 4,785,477 | A | | 11/1988 | Marzo |
| 5,020,161 | A | * | 6/1991 | Lewis et al. ..... 2/164 |
| 5,187,814 | A | | 2/1993 | Gold |
| 5,244,716 | A | | 9/1993 | Thornton et al. |
| 5,542,125 | A | | 8/1996 | Zuckerwar |
| 5,740,551 | A | * | 4/1998 | Walker ..... 2/16 |
| 2005/0076418 | A1 | * | 4/2005 | von Blucher ..... 2/161.6 |

* cited by examiner

Fig. 12
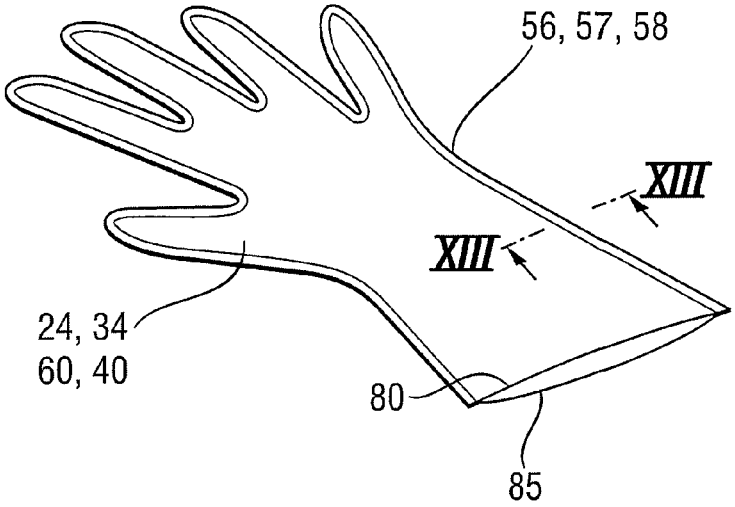
Fig. 13
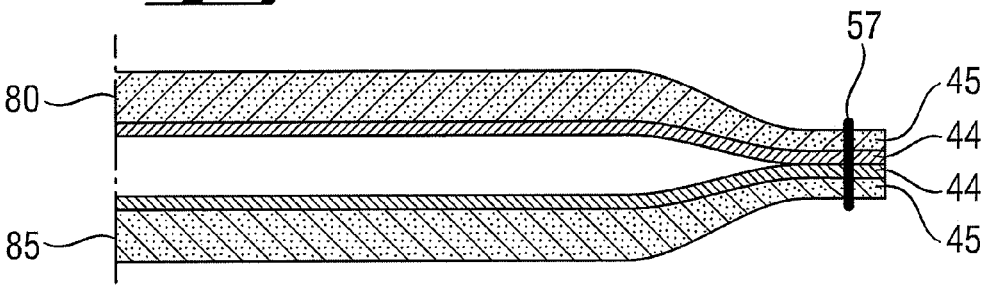
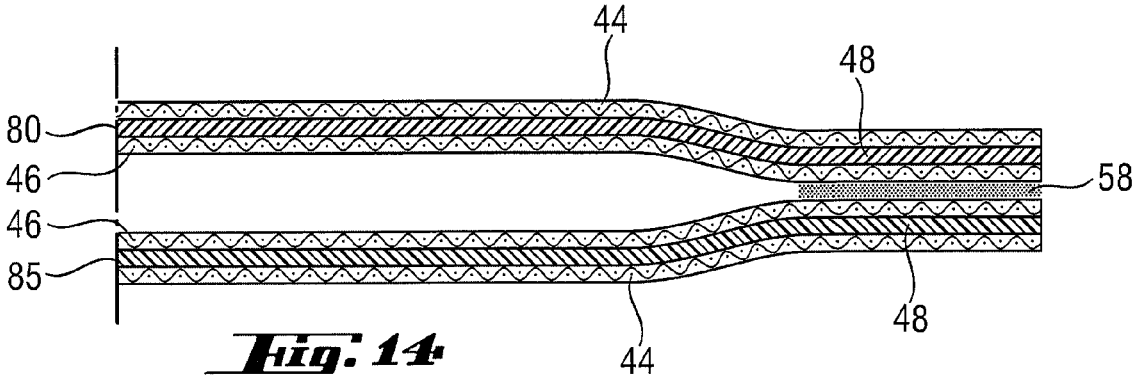
Fig. 14

PIECE OF GARMENT

The present invention relates to a garment, in particular a glove, within which the wearer can change between at least two different functional chambers. Accordingly, the garment is capable of meeting different, conflicting requirements, such as for example high insulating capacity and great flexibility and tactility of the body parts, in particular in the case of the fingers of a hand. The wearer is consequently able to use the same garment for different purposes.

Garments with specific functional properties are worn in various applications, such as for example when engaging in outdoor pursuits, sporting activities, skiing, riding a bicycle or motorcycle, military operations or fire fighting. Depending on the respective activity, the garment may be designed to be liquid-impermeable, windproof, water-vapor-permeable, heat-insulating, flame-retardant or cut-resistant. These properties can be respectively realized in the garment independently on their own or occur in combination with one or more of these properties.

These garments are generally made up of a number of material layers arranged one on top of the other, at least one of these material layers representing a protective material layer. In the case of waterproof and water-vapor-permeable clothing, thin functional layers in the form of films or membranes of polytetrafluoroethylene (PTFE), of expanded PTFE provided with hydrophilic impregnating agents or layers, of breathable polyurethane layers, or of elastomers such as copolyether ester and laminates thereof are frequently processed as the protective material layer.

Nowadays, a protective garment is expected to meet a number of requirements simultaneously. In most cases, however, the requirements are competing properties, which means that realizing one property causes another property to be restricted. For example, a ski glove is intended to protect against cold, dampness and wind. For this reason, a ski glove comprises a number of material layers, for example at least one insulating layer and a waterproof and windproof layer, which together with the outer material form the glove as layers lying one on top of the other. This multilayered structure leads to an increase in the thickness of the glove, which in turn leads to a decrease in the dexterity of the fingers, that is to say the nimbleness of the fingers, and the gripping and feeling properties (tactility) of the fingers of the wearer. The tactile dexterities of a hand are restricted by thick and rigid glove constructions. The restricted dexterities of the fingers cause an increased risk of accident, since gripping movements and clasping actions cannot be safely carried out. In addition, there is the disadvantage that, when insulating material is used, the insulating performance cannot be variably adapted to the different needs of the wearer. Depending on the intensity of the activity and the ambient conditions, the winter clothing should offer protection against a chilling effect during the inactive phase, whereas the protective clothing should offer maximum freedom of movement and possibly heat dissipation in the active phase (climbing, skiing).

In a further example, that of a motorcycle glove, optimum grip conflicts with waterproofness and heat insulation when riding in the rain. The incorporation of a waterproof functional layer in the glove can lead to this further layer between the finger and the outer material of the glove restricting the gripping feeling on the handlebars of the motorcycle, and consequently the control over the motorcycle. One of the reasons for this is that the waterproof functional layer is adhesively bonded to the outer material, which increases the thickness of the glove and its flexural rigidity. In constructions in which the waterproof functional layer is loosely attached as an inner glove inside an outer glove, the waterproof functional layer may become worn through, at least at the fingertips, by the movement of the layers sliding one against the other.

A protective glove as a working glove generally has a number of protective layers, to protect against the ingress of liquids and/or gases from the outside as well as heat or cuts/stabs and so on. However, some of these protective layers, such as for example the layer protecting against cuts and stabs, are only required at times, but in practice are nevertheless permanently integrated in the glove and form a rigid, thick and heavy glove. Precisely in the case of a protective glove, however, good dexterity or tactility of the fingers is important to allow the required work or activities to be safely carried out.

The prior art shows various ways of solving the problem of combining competing properties in a glove.

U.S. Pat. No. 4,662,006 (Ross) describes a multilayered glove comprising a multilayered outer glove and a multilayered removable (detachable, exchangeable) lining glove. The outer glove is made up of an outer, water-repellent layer, an inner, heat-insulating layer and a waterproof, breathable layer arranged between the outer layer and the inner layer. In addition, the inner surface of the inner insulating layer has a sliding layer.

The lining glove can be selectively positioned within the outer glove and serves for additional heat insulation. The lining glove is constructed from different insulating materials, the outer surface of the lining glove having a rough surface layer. The use of the sliding layer and the rough layer on the one hand assists insertion of the lining glove into the outer glove and on the other hand keeps the lining glove in the desired position within the outer glove. To fasten the lining glove in the outer glove, fastening means, such as for example zip fasteners or Velcro fasteners, are provided at the cuff of the lining glove and of the outer glove.

The user of the gloves can wear the outer glove separately. In the case where he requires additional heat insulation, the user can first put his hand into the lining glove and then slide his hand with the lining glove into the outer glove. The two gloves are fastened to one another by the fastening means at the cuff.

A disadvantage is that the lining glove always has to be taken along separately, in order for it to be available if need be. Furthermore, the insertion of one glove into another leads to a very thick multilayered glove, which means very low tactility of the fingers for the wearer.

U.S. Pat. No. 4,785,477 (Marzo) describes a mitt with a glove part for receiving the four fingers of a hand and a thumb part for receiving the thumb, the mitt with the thumb part consisting of a thermal insulating material, which restricts the tensile sensitivity of the wearer. The glove part has a separate forefinger compartment for receiving the forefinger, which is in connection with the glove part. The forefinger compartment is made of a thin, flexible material and does not restrict the dexterity of the forefinger.

The forefinger compartment is in connection with the glove part through an opening in the front of the hand of the glove part. Normally, all four fingers are in the glove part in order to keep them warm. For certain tasks, the forefinger is inserted from the glove part into the forefinger compartment through the opening. The mitt does not have to be taken off for this purpose.

A disadvantage of this construction is that the forefinger compartment is only intended for the forefinger; the other fingers and the thumb continue to have restricted tactility. Only the forefinger can choose between two functional positions. The production of such a mitt is very complicated, since the forefinger chamber has to be adapted to the opening of the front of the hand.

U.S. Pat. No. 5,542,125 (Zuckerwar) describes a glove comprising a basic body with two exchangeable caps. The caps are on the one hand a finger cap and on the other hand a mitten cap. The respective cap is removably joined to the basic body by fastening means. The basic body and the two caps are produced from a waterproof and insulating material. The basic body covers the back of the hand, the front of the hand, the wrist and the thumb. The lower opening of the basic body contains fastening means such as a zip fastener or a Velcro fastener. The caps have a fastening means suitable for them. If manual dexterity of the fingers is required, the cap with the individual fingers is fastened to the basic body. If mainly protection against the cold is required, the mitten cap is fastened to the basic body.

The hand itself always remains in the basic body. Depending on requirements, either the one cap or the other cap is fastened to the basic body. There is only ever one cap on the basic body.

A disadvantage is that it is only ever possible to fasten one cap to the basic body, so the second cap has to be taken along separately in case it is needed. The changing of the caps requires skill and time and is consequently complicated.

U.S. Pat. No. 4,759,084 (Madnick et al) describes a glove with an selectively formed chamber for receiving a selectively formed chemically heating element. For example, there is a rectangularly formed chamber in the region of the front of a hand. In one embodiment, the glove with the chamber may be fingerless, in a further embodiment the fingerless glove represents the removable inner lining glove in an outer glove for use in cold weather. A special embodiment comprises an outer glove and a lining glove, which can be inserted into the outer glove. The lining glove has in the region of the fingers a chamber which is directed inward from the finger tips, is arranged between the material of the back of the hand and the material of the front of the hand and into which the chemically heating element is inserted from the outside. The fingers in the lining glove may be located on the upper side or the lower side of the chamber according to choice, depending on whether the heating element is intended to warm the backs of the fingers or the fronts of the fingers (FIGS. 19-21).

The finger region of a glove insert (mitten glove) is subdivided into two chambers with the same function by means of an inwardly folded material layer. In the fold formed on the outside there is a chemical heating element, which warms the fingers. If the fingers lie above the fold (upper chamber), the fronts of the fingers are warmed, if the fingers lie under the fold (lower chamber), the backs of the fingers are warmed.

A disadvantage is that the insert according to the invention is intended for insertion into an outer glove. This consequently has the end effect again that in the overall glove there are a number of material layers, which greatly hinder the tactility of the hand. Only the forefinger can be extended through an opening in the insert into the outer glove, to improve the feeling of this single finger. The chambers only have one function, that of arranging the heating element on the backs of the fingers or the fronts of the fingers.

Starting out from the problems presented above and the prior art described, the object of the present invention is to provide an improved garment, in particular an improved glove, which offers the wearer adequate protection against external conditions and/or foreign substances under different working conditions and/or weather conditions and at the same time allows adequate freedom of movement and dexterity of the body parts located in the garment. The object of the invention is in particular that of an improved glove which offers the wearer adequate protection against external influences such as foreign substances or bodies while ensuring the tactility and dexterity of the fingers of the hand. The garment is intended to be simply constructed for the wearer and simple to handle.

The object is achieved by the independent claims 1 and 38. The dependent claims describe preferred embodiments.

To achieve this object, claim 1 proposes a garment which has an outer layer which encloses at least one inner space with at least one opening for receiving a body part. The inner space is divided into at least two adjacent chambers, each chamber having at least one chamber opening which is arranged in the opening of the inner space. The adjacent chambers are accordingly arranged parallel to one another. Arranged in the opening of the inner space means that the at least two chamber openings are inserted in the inner space opening in such a way that they fill the inner space opening.

The independent claim 38 claims as an independent solution a glove which has an outer layer which encloses an inner space for receiving a hand. This inner space is divided into at least two adjacent chambers, each chamber having a chamber opening and the chamber openings being arranged in the opening of the inner space. The adjacent chambers are accordingly arranged parallel to one another. Here, too, arranged in the opening of the inner space means that the at least two chamber openings are inserted in the inner space opening in such a way that they fill the inner space opening.

The construction according to the invention consequently allows the wearer to be provided selectively with at least two chambers for one and the same body part within the garment, in particular within a glove. Accordingly, the wearer can insert the body part or the hand either into one or the other chamber of the glove.

Preferably two chambers are provided, but there may also be more than two chambers arranged in the inner space. Preferably, the inner space has a first chamber with a first chamber opening and a second chamber with a second chamber opening; the chambers are arranged parallel to one another, so that the chamber openings are arranged next to one another within the opening of the inner space for selectively receiving a body part or a hand. For this purpose, the inner space opening has an inner space opening edge and each chamber opening has a chamber opening edge, the chamber opening edge being joined, in particular sewn, to the inner space edge. Each of the at least two chambers has the shape of the inner space, in the case of a glove for example each chamber has the glove form of the outer glove.

The chambers are designed in such a way that, when the wearer uses one chamber, the other chamber is completely compressed and lies against part of the inner surface of the outer layer. Consequently, in practice it is only ever possible for one chamber to be used. The chambers are functionally different, so that the wearer uses a chamber to correspond to the desired function. Accordingly, the first chamber may have at least one first function and the second chamber at least one second function. The first function and the second function are different; in some embodiments, the functions may also be the same but of different degrees, for example the chambers may have insulating layers of different thicknesses, and consequently a different level of insulating capacity. The garment according to the invention consequently performs different functions without the wearer having to put on additional garments. Each chamber has a chamber material which exclusively contains the material layers necessary for the intended function.

The material layers lying one on top of the other that are provided in the prior art are divided between the at least two chambers according to the invention in such a way that no chamber has material layers with competing properties.

The chambers have at least one chamber material and the outer layer has at least one outer layer material.

In an embodiment with two chambers, the first chamber is constructed with a first chamber material and the second chamber is constructed with a second chamber material. The first chamber material is mainly different from the second chamber material. Different means that the chamber materials differ from one another in their material composition, thickness, arrangement of the material layers, etc. Consequently, each chamber can be assigned at least one special function by the choice of chamber material. One chamber is for example responsible for protection against water, gases and wind, another chamber effects the protection of the body part against cold, or one chamber provides protection against heat and fire or the risk of stabbing and cutting. Preferably, the chamber material of one chamber is provided with a smaller thickness than the chamber material of the further chamber. For example, one chamber has a thick insulating layer and the further chamber has a thin insulating layer to satisfy different insulating requirements. Furthermore, in the case of a glove, for example, the thicker chamber materials are arranged in the region of the back of the hand and the thinner chamber materials are located in the region of the front of the hand, in order largely to retain the dexterity of the fingers of the hand.

In one embodiment, at least one chamber consists at least partly of outer layer material. Especially in one example, the second chamber is formed with a first chamber material and with the outer layer material.

The at least one chamber material and/or the outer layer material have at least one protective material layer. This protective material layer has at least one layer from the group comprising an insulating material, a functional layer material, a heat-resistant and/or flame-retardant material, a cut-resistant material and combinations of these layers. The layer of functional layer material is preferably liquid-impermeable and has a microporous polymeric membrane of expanded polytetrafluoroethylene.

Preferably, the first chamber material has a first protective material layer in the form of a layer of at least one insulating material. This has the advantage that the chamber of this first chamber material is mainly responsible for the thermal insulation of the corresponding body part or the hand.

Preferably, the first chamber material has a first protective material layer comprising a layer of at least one insulating material and a layer of at least one functional layer material. This combination of materials has the advantage that, in addition to the insulating effect, the functional layer offers protection for example against ingress of liquids, water, air or wind.

Preferably, the first chamber material has a first protective material layer in the form of a layer of at least one cut-resistant material. This allows the wearer to be particularly protected if need be from stabbing on cutting injuries.

The second chamber material preferably has a layer of textile material. This advantageously achieves the effect that the second chamber has particularly thin chamber walls, and consequently the tactility of the body part or the hand is scarcely restricted. In a further embodiment, the second chamber material has a second protective material layer in the form of a layer of at least one insulating material. This is advantageous for the cases where the second chamber is also intended to offer a certain thermal insulation. However, this insulating layer is thinner in comparison with the first chamber material, so that the tactility of the body part or the hand is not restricted.

In a further embodiment, the second chamber material has a second protective material layer in the form of a layer of at least one functional layer material. Here, the advantage lies in the fact that only the second chamber has features such as waterproofness for example.

The outer layer material preferably has a third protective material layer in the form of a layer of at least one heat-resistant and/or flame-retardant material. This construction is particularly of advantage for firefighters, because they are consequently protected against heat and fire, irrespective of which chamber function has been chosen.

Preferably, the outer material layer has a third protective material layer in the form of a layer of at least one functional layer material, preferably a liquid-impermeable functional material layer. This embodiment has the advantage that the garment or the glove as a whole is made to be liquid-impermeable and the wearer can additionally choose between the functions of the chambers.

Preferably, the outer layer material has a second protective material layer in the form of a layer of at least one cut-resistant material. This has the advantage that the garment or the glove provides protection at any time from stabbing or cutting injuries.

The chambers must be fastened to the outer layer in such a way that pulling out of the chambers from the outer layer is prevented and the wearer can easily slip into the desired chamber. For this purpose, the chambers are fastened to one another, within the opening of the inner space and at the inner surface of the outer layer. In one embodiment, at least one chamber is joined to the outer layer. The chambers are preferably attached in the inner space in such a way that they cannot be displaced with respect to one another, for example the at least two chambers are sewn or adhesively bonded to one another, for example at their edge regions or at the tips of the fingers and the chamber openings.

In one embodiment, the forming of the at least two chambers may take place by means of at least one flexible material layer, which separates the cross section of the inner space centrally in the direction of the longitudinal axis of the latter. It is important that the area of the flexible material layer is at least half the inner area of the inner space, in order that, when one chamber is being used,. the material layer can lie completely against the inner surface of the outer shell, whereby the unused chamber is completely compressed. In this way, each chamber provides approximately the same chamber volume for the wearer. The flexible material layer is formed from at least one chamber material.

In a further embodiment, the first chamber material forms a first garment insert, which has the same form as the inner space. This garment insert is provided in the inner space, along the longitudinal axis of the latter, in such a way that one side of the insert forms the flexible material layer.

In a further embodiment of the invention, the second chamber material forms an additional second garment insert, which is likewise fastened along the longitudinal axis of the inner space and parallel to the first garment insert in the inner space, so that the flexible material layer is formed by means of in each case the sides of the insert that lie one on top of the other and are adjacent one another.

The first chamber preferably contains material layers which primarily protect the wearer and improve the wearing comfort and do not necessarily have to allow for such properties as for example freedom of movement and maintaining the sense of touch and feel. On the other hand, the second chamber is constructed with at least one thin material layer which is made to match the anatomical features of the wearer, with the result that the tactile properties of the wearer are largely retained. In the example of a glove, the first chamber is assigned to the back-of-the-hand region of the glove and comprises thicker layers such as insulating layers or layers protecting against stabbing and cutting. The second chamber is assigned to the front-of-the-hand region of the glove and has, if at all, only a very thin material layer, in order not to restrict the mobility of the fingers any further. Depending on the needs of the wearer, he can use either the one chamber or the other chamber. If the wearer changes to one chamber, the other chamber is automatically compressed and does not get in the way when the other chamber, respectively, is being used.

Since the chambers are arranged adjacent one another, and consequently in parallel within the garment or glove, the wearer does not have to separately take along an additional glove for specific functions and if need be change to it or additionally attach it. In particular, there is no longer any need for the difficult and laborious joining together/fitting together of pieces of clothing with different functions. With the solution according to the invention, in the future the wearer does not suffer any disadvantages caused by additional protective layers at the expense of tactility. In the case where great tactility is desired, he merely has to slip into the corresponding thin chamber. If a specific protective function is most important, the wearer changes to the chamber with the specific protective material layer.

In another embodiment, the chambers meet different insulating requirements, in that one chamber has only a thin insulating layer, whereas the other chamber has at least one thicker insulating layer or a number of insulating layers. Consequently, the wearer can choose between a high insulating effect and a lower insulating effect to correspond to the outside conditions.

In this case, each chamber has the form of the inner space in which it is arranged. For instance, in one example the inner space may be the interior of a jacket sleeve, the at least two chambers likewise respectively having the form of a jacket sleeve.

In the case where the inner space of a pant leg is concerned, the at least two chambers are respectively in the form of a pant leg.

If the inner space is an inner space of a shoe, the at least two chambers respectively correspond in their form to the interior of a shoe.

In a further embodiment, the invention is achieved by a glove which has an outer layer with a back-of-the-hand region and a front-of-the-hand region and the inner space formed by the outer layer is divided into a first chamber and a second chamber. The chambers are arranged adjacently in the inner space in such a way that the first chamber is arranged between the back-of-the-hand region and the second chamber and the second chamber is arranged between the first chamber and the front-of-the-hand region. The outer layer has an outer layer material with a protective material layer, such as for example a liquid-impermeable functional layer, so that the entire glove including the chambers is protected against the ingress of liquid such as water.

The first chamber may be formed by a multilayered first inner glove, which has at least one layer of insulating material and at least one layer of a textile material.

The second chamber is formed by a second inner glove, which has at least one layer of a textile material.

Such a glove gives the wearer the possibility of choosing within a liquid-impermeable glove between a first insulating chamber in the case of cold and a second, thin and tactile chamber for the case where the tactile properties of his fingers are required. The first insulating chamber is located in the back-of-the-hand region and may be a conventional ski glove. The second chamber comprises only a textile inner liner and is arranged in the front-of-the-hand region. One side of the first chamber and one side of the second chamber respectively lie against one another and are joined to one another in a non-slip manner. If the wearer enters the second chamber, the first chamber is pressed completely along the back of the hand. As a result, ¾ of the surrounding area of the fingers and the hand are without the thicker insulating material layer, and consequently have a great tactility and dexterity of the fingers.

A further embodiment provides a glove according to the invention as described above. As a difference from it, the first chamber comprises an inner glove with a protective material layer in the form of a liquid-impermeable functional material layer, which is joined to a textile layer. In addition, this inner glove may also contain an insulating material layer. The second chamber is formed merely by the material of the outer layer and the first chamber. This embodiment is suitable in particular for motorcycle gloves, since in the second lower chamber there is only the material of the outer layer between the hand of the rider and the handlebars of the motorcycle. Consequently, the rider has an optimum gripping feel for riding. If need be, for example when riding in rain, the rider changes from the very tactile second chamber into the first chamber, which is made to be slightly insulating and waterproof.

In a further embodiment, a protective material layer, such as a layer providing protection against fire, impact, cuts or stabs, may be provided in the first chamber instead of the insulating layer or the liquid-impermeable layer. For example, the first chamber may have one or more of these protective material layers.

Depending on requirements, the protective material layers of the first chamber may vary with one another, as long as the second chamber gives the hand the necessary tactile properties.

The invention is now to be explained in more detail on the basis of drawings:

FIG. 9 shows a cross section along the line IX-IX in FIG. 8 in a second embodiment;

FIG. 12 shows an inner glove in a perspective representation;

FIG. 13 shows a section along the line XIII-XIII in FIG. 12 in a first embodiment;

FIG. 14 shows a section along the line XIII-XIII in FIG. 12 in a second embodiment.

Figure 1:
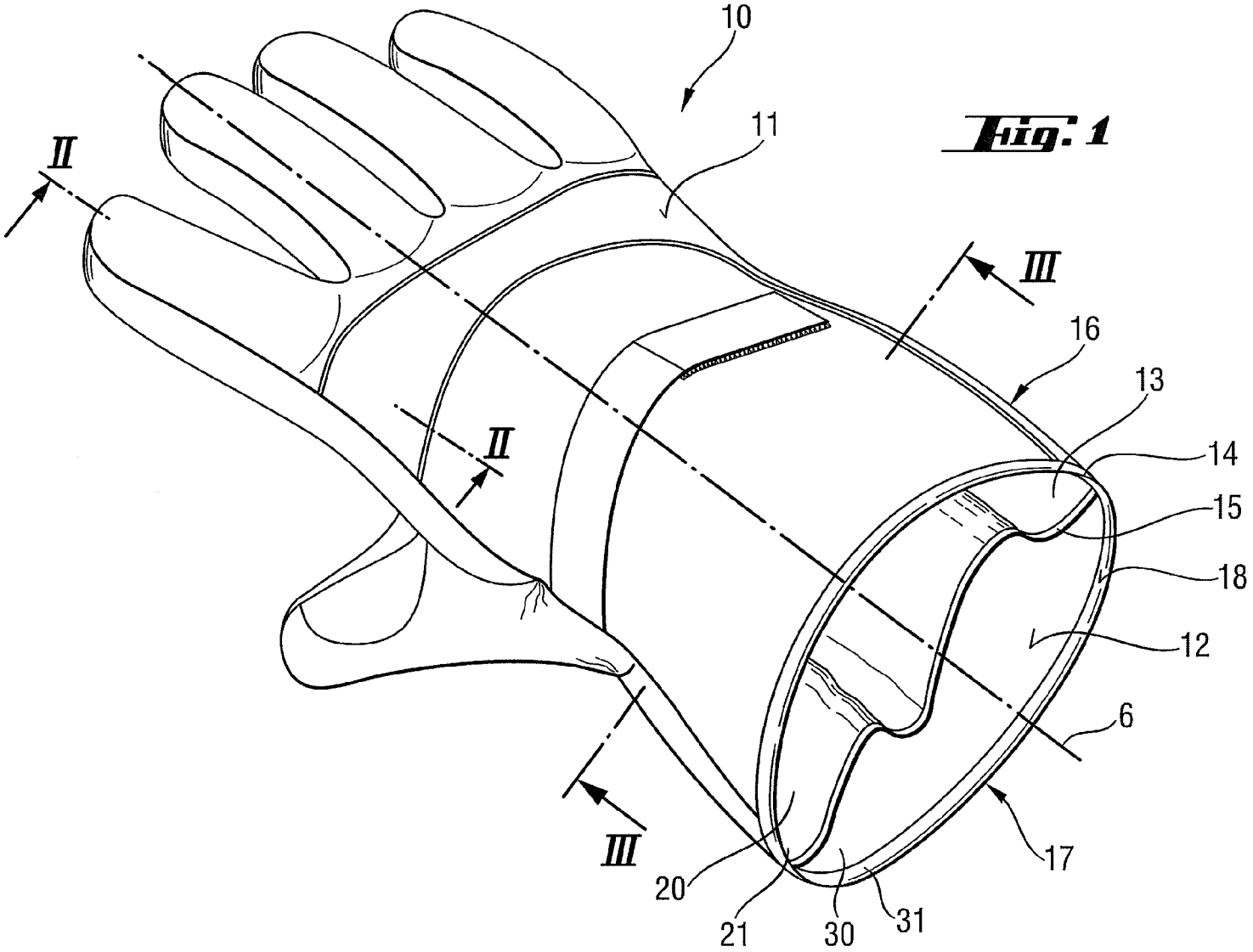
FIG. 1 shows a garment according to the invention in the form of a glove in a perspective representation.

FIGS. 1 to 14 describe the invention by the example of a glove.

In the variously described embodiments, the same parts are provided with the same designations. The positional indications chosen in the description, such as for example upper, lower, lateral etc., apply to the figure that is directly being described and presented and, if there is a change in position, are to be transferred analogously to the new position. Individual features or combinations of features from the exemplary embodiments shown and described may in themselves represent solutions that are independent, inventive or according to the invention.

Some of the terms of the invention are explained in more detail below:

The outer layer forms the outermost region of the garment and has an outer area in contact with the external surroundings. The outer layer comprises one or more material layers and has an inner surface, which encloses at least one inner space for receiving a body part of a user. Furthermore, the outer layer may be formed by one or more outer layer parts, which may be joined by means of joining elements, such as a welded, adhesively bonded or sewn seam. The outer layer parts may in this case consist of the same or different materials, in particular of textile materials, leather materials, flexible plastics etc., which may be processed by methods known from the prior art, such as for example rendered hydrophobic, rendered oleophobic, embossed, etc. The textile materials are woven or knitted fabrics and may be chosen from the group comprising polyamide, polyester, polypropylene, polyaramids, nylon and cotton.

The garment according to the invention is not restricted to the embodiments of a glove that are represented in the figures. The garment may be formed by any desired clothing that covers a body part of a user. Preferred configurational variants of the garment according to the invention concern gloves in particular, but pants, in particular pant legs, jackets, in particular jacket sleeves, or shoes may also be concerned.

The glove is a finger glove or a mitten. Both forms of glove have a back-of-the-hand region (upper hand part), a front-of-the-hand region (inner hand part) and finger side parts lying between the fingers, which are preferably sewn to one another. The mitten has in the region of the four fingers a finger side part which encloses all four fingers together, so that the four fingers lie in a common cover.

The term back-of-the-hand region describes the upper hand part of the glove which covers the back of a hand including the backs of the fingers and the back of the thumb. The term front-of-the-hand region describes the inner hand part of the glove which covers the palm of the hand or the front of the hand including the ball of the thumb and the associated areas of the fingers and thumb.

In a further embodiment, the outer glove is a combination of a finger glove and a mitten. For this purpose, the back-of-the-hand region is formed like a mitten, the front-of-the-hand region is in the form of a finger glove. This combined glove has the advantage that the mobility and tactility of the individual fingers is reproduced in the front-of-the-hand region, whereas the fingers are covered by a common cover in the back-of-the-hand region.

In one embodiment, the glove according to the invention in itself represents an inner glove (glove insert) which is inserted into a further outer glove and is fastened to it by known fastening means. The fastening of the inner glove to the outer glove may be permanent or releasable in the case of an inner glove that can be removed, and consequently can be changed.

The term chamber describes a space which is arranged within the inner space of the outer layer and is partly formed by outer layer material and a chamber material or is formed by at least one chamber material. The chamber serves for receiving a body part of a user and largely coincides in its outer form and dimensions to the inner space of the outer layer. According to the invention, at least two chambers are provided in the inner space. The chambers are arranged parallel to one another in the inner space of the outer layer, so that in the case where a body part is in one chamber, this chamber completely fills the inner space. The other chamber, in which there is no body part, is pressed as a result along its longitudinal axis in such a way that there is for the most part no longer any spatial volume in the chamber. This pressed chamber is then located either along the inner surface of the front-of-the-hand region or the back-of-the-hand region.

Insert relates to an inner garment such as an inner glove which is located within the outer layer and covers the skin of the wearer. The inner glove is normally very thin and may have in particular one or more thin protective material layers, which protect against contamination by toxic and/or non-toxic liquids and/or gases and/or mechanical effects. The insert may be liquid-impermeable, preferably waterproof and/or water-vapor-permeable. The insert is preferably a membrane or laminate insert. In one example, the insert is a very thin inner glove which encloses the first or the second chamber. However, the insert may also be produced only from a textile lining material.

For this invention, laminate is a composite of layers which has at least one functional layer and at least one textile layer. The at least one functional layer and the at least one textile layer are joined to one another by means and methods known from the prior art. The functional layer is preferably made of a polymeric material.

The term "tactility" describes the capability of feeling, touching or grasping something; tactility is often described as fingertip sensitivity.

Textile layer (textile materials, textiles) describes a knitted or woven material. This material has synthetic fibers, natural fibers, or mixtures of synthetic fibers and natural fibers.

Protective material layer is a material layer or a laminate which, in a garment such as for example a glove, protects the wearer from the external effects of foreign substances and/or foreign bodies. The protective material layer may be a component part of the outer material and be made to face the surroundings directly. It may, however, also be arranged inside the garment and be made to face the wearer directly.

Water Ingress Pressure Test (Suter Test)

The water ingress pressure test is a hydrostatic resistance test which is essentially based on water being forced against one side of a sample of material and the other side of the sample of material being observed for the transmission of water. The water pressure is measured according to a test method in which distilled water at 20±2° C. is increasingly put under pressure on a sample of material with a surface area of 100 $cm^2$. The rise in water pressure is 60±3 cm of $H_2O$/min. The water pressure is then the pressure at which the water appears on the other side of the sample. The exact procedure is regulated in ISO standard No. 811 from 1981. "Waterproof" is to be understood as meaning that a material withstands a water ingress pressure of at least 7 kPa, preferably more than 7 kPa, preferably of 10 kPa. Often the Suter test is also used, based in principle on the description in ISO 811-1981. The test method is based on a small change in pressure acting on the sample of material in that water is forced against one side of a sample of material and the other side of the sample of material is observed for the transmission of water.

For the test, the sample of material is tightly fixed between rubber seals in a holder, so that water can be applied to a sample area of 7.62 cm in diameter. The water is supplied to one side of the sample at an air pressure of 0.07 bar (7 kPa). The opposite side of the sample is visually inspected for the transmission of water for 3 minutes. If no transmission of water can be observed, the sample has passed the test and is considered to be waterproof.

Water Vapor Transmission Resistance Ret

The Ret value is a specific material property of sheetlike structures such as the functional layer according to the invention or composite materials (laminates), which determines the latent evaporation heat flux through a given area under a constant partial pressure gradient.

"Water-vapor-permeable" defines a material which has a water vapor transmission resistance Ret of below 150 $m^2Pa/W$. The sheetlike structure preferably has a Ret of below 20 $m^2Pa/W$. The water vapor permeability is measured by the Hohenstein MDM dry method, which is described in standard test specification No. BPI 1.4 (1987) of the Bekleidungsphysiologischen Instituts [Apparel Physiological Institute] e. V. Hohenstein.

"Microporous" is to be understood as meaning a material which has very small microscopic pores through the internal structure of the material and the pores form an interlinked continuous connection or path from one surface to the other surface of the material. In accordance with the dimensions of the pores, the material is consequently permeable to air and water vapor, but liquid water cannot pass through the pores.

FIG. 1 schematically shows the principle of the invention. For this purpose, a garment in the form of a finger glove 10 is depicted in FIG. 1. Instead of the finger glove, a mitten may also be provided.

In principle, the garment according to the invention is intended to ensure that at least one body part of a wearer of the garment is reliably protected from contact with a foreign substance and/or foreign body externally acting on it. At the same time, the sense of touch and feel and the freedom of movement of the wearer are to be maintained. Water in particular comes into consideration as the foreign substance, but other types of foreign substances or media are also possible, such as for example chemical, alkaline or acid substances, microparticles, gases, aerosols, particles such as for example odor particles, which under some circumstances can be hazardous to health and toxic for the wearer. The foreign substance may also act in the form of flames, fire, vapor and heat. Understood as a foreign body are pointed and sharp items that are capable of mechanically harming the garment. These include cutting and punching tools, knives, scissors, shards, fragments and the like.

The glove 10 has an outer layer 11 with an inner surface 12, which encloses an inner space 13 for receiving the hand of a user. The inner space 13 has an inner space opening 14 with an inner space edge 18 for inserting and removing the hand.

The inner space can assume different shapes. In the case of a glove, the inner space is the interior of the glove. If the garment is a pair of pants for example, the inner space may be the interior of a pant leg. In the case of a jacket, the inner space may be the interior of one jacket sleeve. In the case of a shoe, the inner space may be the interior of the shoe.

The glove 10 has a back-of-the-hand region 16 and a front-of-the-hand region 17 as well as finger side parts lying between the fingers, which are joined to one another, preferably sewn.

In special embodiments, such as for example in the case of a firefighting glove, the outer layer may have a cuff which covers the arm of the wearer over and beyond the wrist. In this case, the inner space opening may be provided in the wrist region.

The inner space 13 is divided into at least two adjacent chambers 20, 30. Depending on requirements, it is also possible for three or more chambers to be provided in the inner space 13.

Adjacent means that the chambers 20, 30 are arranged parallel to one another, and consequently have at least one common chamber wall, which completely divides the cross section of the inner space 13 in the direction of the longitudinal axis of the latter. Each chamber is separate in itself and has at least one chamber opening 21, 31, which is arranged in the inner space opening 14. If the garment is a jacket sleeve or a pant leg for example, each chamber must have two chamber openings, in order that the arm or the leg can be inserted through the desired chamber. The chambers 20, 30 lie next to one another in parallel in such a way that they fill the inner space 13 along the longitudinal axis of the latter. The chamber openings 21, 31 are located in the inner space opening 14 and fill the latter. The inner space opening 14 is consequently formed by the two chamber openings 21, 31 and their chamber opening edges. Consequently, each chamber extends parallel to the other chamber, respectively, from the tips of the fingers (in the case of a mitten from the tip of the glove), including the tip of the thumb, up to the inner space opening 14.

The individual chambers may be formed by means of at least one flexible material layer or chamber wall 15, which divides the inner space 13 in cross section centrally in the direction of the longitudinal axis 6 of said inner space. Flexible material layer 15 means that the material layer does not lie rigidly and immovably in the inner space 13. On the contrary, the material layer 15 is made of a flexible material and designed in its dimensions in such a way that, depending on the use of the chambers, it can come to lie against the inner surface 12 of the outer layer 11 either in the back-of-the-hand region 16 or in the front-of-the-hand region 17. According to one embodiment, the material layer 15 may be joined at its peripheral edge to the outer layer 11.

In FIG. 1, the flexible material layer 15 is a material layer in the form of the front of a hand, which divides the inner space 13 along the longitudinal axis 6 of the latter from the tips of the fingers, including the tip of the thumb, up to the inner space opening 14. The inner space 13 is consequently divided into two chambers of equal size in the form of a hand. In the form of a hand means that, in the case of a finger glove, each chamber has the form of a hand with four fingers and a thumb, in the case of a mitten each chamber has the form of a glove with only the thumb having a finger compartment of its own and the region of the other fingers being formed by a single contiguous compartment.

Figure 4:
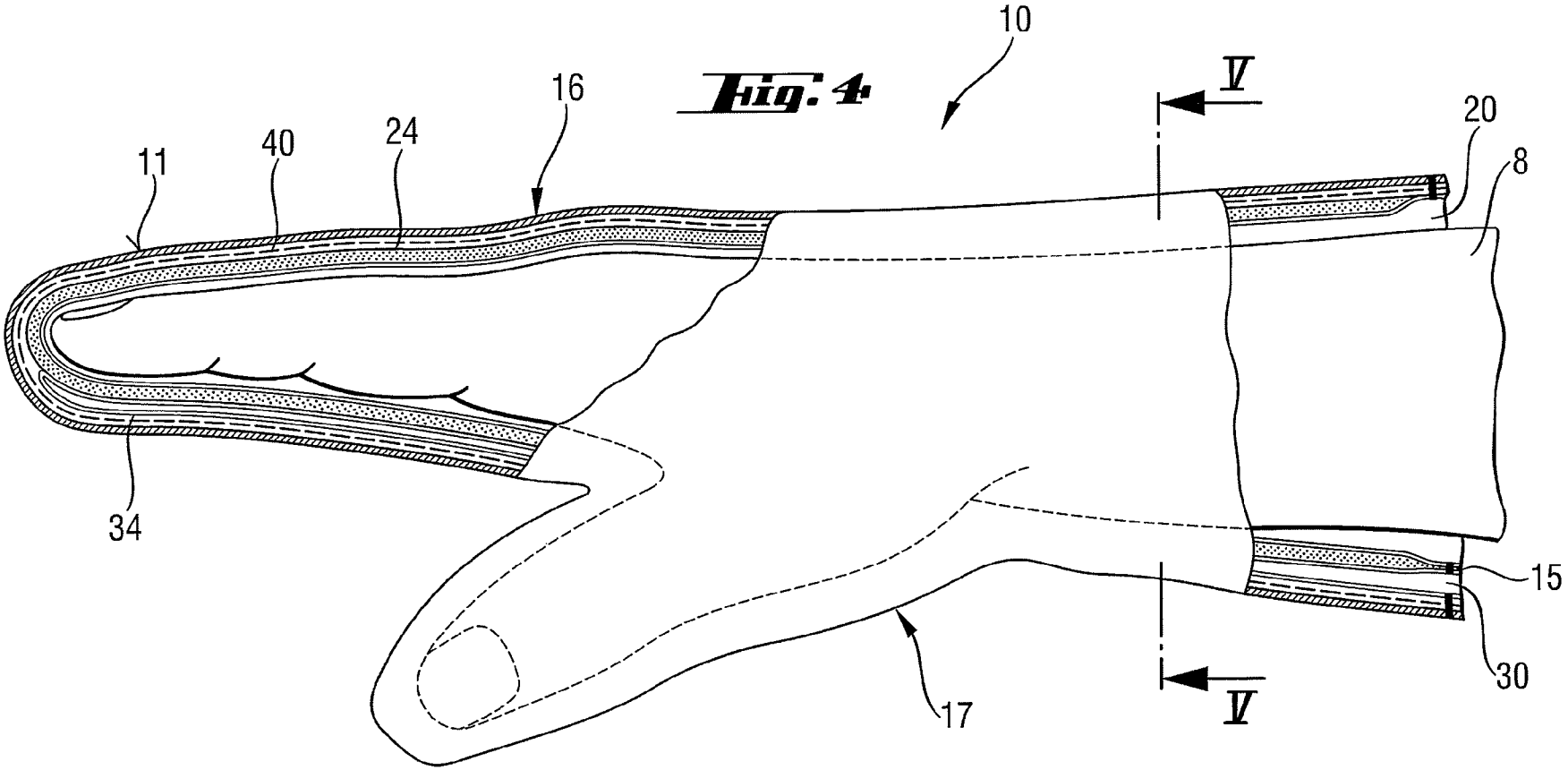
FIG. 4 shows a partial longitudinal section according to FIG. 2 with a hand in a first application situation.

Consequently, the user of the glove can selectively insert his hand into one chamber 20 or the other chamber 30. If the hand is in one chamber, the other chamber, respectively, is compressed in the longitudinal direction and the material layer 15 is located either in the back-of-the-hand region 16 or in the front-of-the-hand region 17. This principle is represented in FIGS. 4 to 7 and 10 to 11. FIG. 4, for example, shows a partial longitudinal section according to FIG. 2, a hand 8 being located in the first, upper chamber 20, as a result of which the material layer 15 lies in the front-of-the-hand region 17 and the second, lower chamber 30 is compressed. The hand 8 may also be located equally well in the second, lower chamber 30, as a consequence of which the first, upper chamber 20 is then compressed in the back-of-the-hand region 16.

According to the invention, it is provided that each chamber provides at least one special function for the wearer. In the case of a glove, the chamber which is closest to the front-of-the-hand region 17 primarily ensures good tactility of the hand. For this purpose, the chamber is constructed from as few layers as possible, in order that the dexterity of the fingers and the gripping feeling of the hand are largely maintained. The chamber which is assigned to the back-of-the-hand region 16 is intended mainly to give a hand protection against external effects such as for example heat or cold, against cuts and stabs, against liquids and/or toxic or hazardous gases. These protective functions may be provided individually or in combination in this chamber. For this, the chamber comprises one or more protective material layers, such as for example insulating material layers or liquid-impermeable functional layers.

If the garments are a jacket sleeve or a pant leg, the chambers are generally intended to provide different insulating performances and at the same time ensure adequate freedom of movement.

In the case of the glove 10 represented in FIG. 1, a first chamber 20 and a second chamber 30 are provided. The chambers 20, 30 are arranged adjacent one another along the longitudinal axis 6 of the inner space 13, so that the first chamber 20 is arranged between the back-of-the-hand region 16 and the second chamber 30 and the second chamber 30 is arranged between the first chamber 20 and the front-of-the-hand region 17. According to the manner of representation in FIG. 1, the two chambers 20, 30 are consequently arranged one above the other in the inner space 13. The chamber openings 21, 31 are likewise provided one above the other within the inner space opening 14, so that the user can choose between the first chamber 20 and the second chamber 30 when putting on the glove.

Furthermore, the chamber openings 21, 31 of each chamber 20, 30 are integrated in the opening of the inner space 14, preferably in such a way that the chamber openings 21, 31 fill the inner space opening 14. For this purpose, the chamber opening edge of each chamber is partly joined to the inner space edge 18. As schematically represented in FIG. 1, only one part of each chamber opening edge is ever joined to one part of the inner space edge. The joining between chamber opening edge and inner space edge takes place for example by sewing, adhesive bonding or welding.

According to the invention, the chambers 20, 30 have at least one chamber material and the outer layer 11 has at least one outer layer material. According to one embodiment, the first chamber 20 has a first chamber material and the second chamber 30 has a second chamber material. The first chamber material is preferably different from the second chamber material, which means that the chambers are respectively constructed from different material layers, and consequently also perform different functions, in a way corresponding to the respective embodiment.

The chamber material or the outer layer material is constructed with at least one protective material layer 45. Embodiments where both the chamber material and the outer layer material contain at least one protective material layer are also possible.

This protective material layer 45 has at least one of the following material layers: a layer of at least one insulating material, a layer of at least one functional layer material, a layer of at least one heat-resistant and/or flame-retardant material, a layer of at least one cut-resistant material. The protective material layer may have one of these aforementioned layers or a number of them in combination. Preferably, the protective material layer is joined to at least one further textile layer, which serves as a reinforcing layer or as a lining layer. The at least one protective material layer 45 protects the enclosed body part or the hand from contact with the aforementioned undesired foreign substances and/or foreign bodies. In this case, the garment or the glove may contain one or more protective material layers, which are to be found either in the outer layer and/or in a chamber or in the chambers.

The protective material layer of insulating material serves the purpose of protecting the body part or the hand from cold or, conversely, preventing heat transfer from the body to the surroundings. According to one exemplary embodiment, the insulating material is at least one of the thermal insulating materials that are customarily used, such as absorbent cotton, foam, nonwoven, felt, staple fiber, down and the like. Preferably, the insulating material is a porous material, and consequently water-vapor-permeable. Material such as Thinsulate® or Thermolite® may be used for example as insulating materials. In one exemplary embodiment, the insulating material is joined to a textile backing layer.

In a further embodiment, the insulating material is formed by means of a controllable insulating construction. According to this embodiment, the insulating construction has at least one inflatable compartment. The inflatable compartment is formed by two flexible air-impermeable and preferably also waterproof layers, which are joined, preferably adhesively bonded, to one another in an airtight manner along the periphery of the compartment. The inflatable compartment has at least one opening through which air can be introduced into the compartment or air can be let out from the compartment to set a desired volume. In a preferred embodiment of the insulating construction, a porous insulating material is arranged in the interior of the inflatable compartment. The porous insulating layer is arranged between the two airtight layers and, if appropriate, integrated in the adhesive seam, in that the adhesive penetrates through the porous insulating material and joins the two layers to form a waterproof, airtight seam. For a full insulating performance, the insulating layer is inflated and the inner insulating material is thick and fleecy. For a reduced insulating performance, the air is let out from the compartment until the previously thick insulating material is pressed into a thin layer.

One of the chambers 20, 30 according to the invention may at least partly have the inflatable and deflatable insulating construction. In the case of the glove, preferably the first chamber, assigned to the back-of-the-hand region, is provided with an inflatable insulating construction.

A protective material layer of functional layer material is to be understood as meaning a barrier layer against the ingress of liquid and/or gaseous substances. Such a functional layer may be a membrane, a film or a coating.

For example, there is a liquid-impermeable functional layer which forms a barrier at least against the ingress of liquid water and ideally also against liquid chemical substances. In one embodiment, the functional layer is liquid-impermeable and water-vapor-permeable. The functional layer may also be water-vapor-permeable and windproof or water-vapor-permeable, waterproof and windproof.

The presence of the functional layer enhances the wearing comfort of the garment, since the wearer's perspiration is transported from the inside to the outside and at the same time the ingress of water and/or wind is stopped. Consequently, the garment altogether is waterproof and water-vapor-permeable. The functional layer may also be a barrier layer against chemical and/or biological toxicants. These toxicants may occur in liquid or gaseous form, as aerosols or in particle form. The functional layer is essentially impermeable to these toxicants.

"Water-vapor-permeable" is understood as meaning a material which has a water vapor transmission resistance Ret of below 150 $m^2$ Pa/W. Preferably, the functional layer has a Ret of below 20 $m^2$Pa/W. A functional layer is considered to be liquid-impermeable if it prevents the ingress of liquid water at a pressure of at least 7 kPa (0.07 bar) minutes. Preferably, the liquid-impermeable functional layer has a water ingress pressure of more than 7 kPa.

Preferably, the functional layer is joined to at least one textile material layer to form a textile laminate. The textile material layer may be a woven or knitted fabric or a nonwoven. A large number of materials, such as polyesters, polyamides (nylon), polyolefins and others may come into consideration as the material for the material layer. Preferably, the textile material layer is a smooth or roughened knitted fabric of polyester or, in the case of use in firefighting protective clothing, of aramid. In one embodiment, the functional layer may be in the form of a 2-ply laminate, a textile material layer being attached on one side of the functional layer. The functional layer may also be in the form of a 3-ply laminate, a textile material layer then being arranged on each side of the functional layer.

In a further embodiment, the textile laminate is fastened as a liner construction on the inner side of the outer layer 11 in such a way that the functional layer is directed toward the inner surface of the outer layer and the textile material layer faces the inner space of the garment. Textile laminates with the waterproof and water-vapor-permeable functional layer described above are obtainable from the company W. L. Gore & Associates under the designation GORE-TEX® laminate.

The functional layer material may also contain chemical and biological protective materials. These protective materials protect against contact with hazardous or toxic substances in the form of liquids, aerosols, vapor or particles. These protective materials, known from the prior art, are used in particular for preventing the transfer of hazardous or toxic substances through the thickness of the functional layer by repelling and adsorbing, by governing or otherwise binding, by breaking down or destroying the substances. For example, such protective materials may have adsorptive chemical protection systems which adsorb the hazardous chemicals in a sorbent, for example based on activated carbon.

Other protection systems comprise chemical or other components which react with the hazardous substances and bind them or break them down, including catalytic cracking of the substances. For chemical and biological protective applications, laminates which have impermeable or selectively permeable layers, such as for example GORE-PAK® material, obtainable from W. L. Gore & Associates, Inc. (Elkton, Md., USA), may be used for example. In a further embodiment, the functional layer is a barrier layer against chemical and/or biological toxicants and has at least one liquid-impermeable, air-impermeable and water-vapor-permeable membrane and at least one adsorption layer based on an adsorbent adsorbing chemical and/or biological toxicants, in particular based on activated carbon.

The functional layer may have porous and/or non-porous materials. For instance, the functional layer may be a composite of a porous polymeric layer and a continuous water-vapor-permeable polymeric layer of a hydrophilic polymer. Preferably, the porous polymeric layer is a microporous polymeric membrane.

The microporous membranes used usually have a thickness of 5 μm to 500 μm, preferably between 50 and 300 μm and with particular preference between 5 μm and 40 μm. Synthetic polymers and elastomers come into consideration as polymers for the microporous membrane. Suitable polymers may be, for example, polyesters, polyamides, polyolefins including polypropylenes and polyesters, polyketones, polysulfones, polycarbonates, fluoropolymers, polyacrylates, polyurethanes, copolyether esters, copolyether amides and the like. A particularly preferred microporous polymeric membrane material is expanded microporous polytetrafluoroethylene (ePTFE). A membrane made of ePTFE is particularly suitable, since it is very stable with respect to heat and high temperatures and neither burns nor melts.

These materials are characterized by a multiplicity of open, interconnected microscopic cavities, a high cavity volume, high strength, compliant, flexible, stable chemical properties, a high water vapor transport and a surface with good dirt-repelling properties. The patents U.S. Pat. No. 3,953,566 and U.S. Pat. No. 4,187,390 describe the provision of such microporous expanded PTFE membranes and their content is hereby incorporated in this application.

In one embodiment, the ePTFE membrane has a water-vapor-permeable continuous, hydrophilic, polymeric layer. Without being restricted to these, suitable continuous water-vapor-permeable polymers are those from the family of polyurethanes, the family of silicones, the family of copolyether esters or the family of copolyether ester amides. Suitable copolyether esters of hydrophilic compositions are disclosed in U.S. Pat. No. 4,493,870 (Vrouenraets) and U.S. Pat. No. 4,725,481 (Ostapachenko). Suitable polyurethanes are described in U.S. Pat. No. 4,194,041 (Gore). Suitable hydrophilic compositions can be found in U.S. Pat. No. 4,2340,838 (Foy et al). A preferred class of continuous water-vapor-permeable polymers are polyurethanes, in particular those which contain oxyethylene units, as described in U.S. Pat. No. 4,532,316 (Henn).

Preferably, the membrane is provided with a textile backing material, which lends the membrane additional protection and strength. The backing material may be laminated with a continuous or discontinuous adhesive layer on at least one of the surfaces of the functional layer. Advantageously, the backing material is a textile sheetlike structure of woven, knitted, natural or synthetic textile materials. Scrims and nonwovens may also be used. Polyesters, polyamides, polyethylene, polyacrylates, polypropylene, glass fiber, fluoropolymer or textile woven from PTFE are suitable in particular as textile materials. Alternatively, a further textile sheetlike structure may be arranged on the other surface of the membrane.

A protective material layer of a flame-retardant and/or heat-resistant material provides a certain degree of protection against burns caused by contact with flames or excessive temperature and comprises materials such as synthetic fibers, in particular aramid fibers and para-aramid fibers, which are obtainable for example under the name Nomex®.

For the flame-retardant property of this protective material layer, the material has an adequate amount of at least one flame-retardant fibrous material. In one embodiment, to limit the spread of flames in conformity with the standard EN 533 (1997), at least 50% of the material comprises a flame-retardant fibrous material. Such a fibrous material may be selected from the group of materials comprising aramids, polyimides, preox fibers, PBI or melamine resin fibrous materials. A flame-retardant fibrous material must be thermally resistant. Preferably, the flame-retardant fibrous material is formed from aramids. In one embodiment, the protective material layer consists of 100% aramid stable fibers. Aramids are extremely flame-resistant, thermally resistant and tear-resistant. The flame-resistant fibrous material preferably takes the form of a yarn. A flame-retardant fibrous material may be characterized by the LOI (Limited Oxygen Index) value. The LOI value corresponds to the minimum content of oxygen that is just enough for the material still to burn. Polymer systems with LOI values of greater than 30-40% oxygen are self-extinguishing, i.e. inherently flame-resistant. Technical polymers have an LOI value of 16-30%. In general, fibers with an LOI>25 are considered to be flame-retardant. It is desirable if the flame-retardant fibrous material has an LOI value of at least 25. The fibrous materials listed above achieve an LOI value of 28-33, for example polyimide achieves an LOI value of 38, PBI a value of 40 and preox fibers even a value of 56-58. The LOI value for the individual fibrous materials is available in the literature, for example in the Denkendorf fiber table of the Institut für Textil- und Verfahrenstechnik [Institute for Textile Chemistry & Chemical Fibers], Denkendorf, Germany. A flame-retardant and/or heat-resistant protective material layer preferably forms the outer material, at least in some regions such as the back-of-the-hand region of a glove.

The protective material layer of a stab- and cut-resistant material serves the purpose of providing protection from external mechanical injuries such as cuts, stabs and the like. A suitable material for this may be a metal woven or knitted fabric or a textile material of particularly stable yarns of aramid fibers, polyamide fibers, polyethylene, graphite, steel or PTFE fibers. Particularly preferred are yarns of para-aramid fibers such as Kevlar® fibers, of polyamide 6.6 such as Cordura® or yarn or fiber blends of the materials listed. This stab- and cut-resistant protective material layer is either a component part of the outer layer 11 and at least partly covers the inner surface or the outer surface of the outer layer or is a component part of the first or second chamber material.

The first chamber material may have at least one first protective material layer 45*a*, which is chosen from the group of layers described above. It may also be provided that a number of protective material layers are combined in the first chamber material. Preferably, the first protective material layer is joined to at least one textile layer. Furthermore, it may be provided that the first chamber material consists only of one textile material or is at least partly formed by the outer layer 11.

In one embodiment, the second chamber material has at least one second protective material layer, which may be chosen from the group of layers described above and is preferably different from the first protective material layer of the first chamber material. It may also be provided that the second chamber material has at least one layer of textile material, leather or synthetic leather. The textile material may be a woven or knitted fabric and consist of possible materials such as polyester, polyamide, nylon, polypropylene, polyaramid and cotton.

In a further embodiment, the second chamber material is at least partly formed by the outer layer 11.

The outer layer 11 has at least one outer layer material. The outer layer forms the outermost region of the garment and has an outer area in contact with the external surroundings. In one embodiment, the outer layer 11 has at least one third protective material layer. As an outer layer material, the third protective material layer may form the entire outer layer or cut-to-size pieces of the outer layer or be provided in addition to the outer layer material. Preferably, the outer layer 11 has an outer layer material and a liquid-impermeable functional layer, arranged on the inner surface of the outer layer material. The liquid-impermeable functional layer is additionally water-vapor-permeable. Preferably, the liquid-impermeable functional layer takes the form of a glove insert, which has at least one laminate with a microporous, expanded polytetrafluoroethylene (PTFE) membrane and a water-vapor-permeable polyurethane layer, which is adhesively bonded to one side of the membrane. In a further embodiment of a glove, the outer layer may be made of a flame-retardant and/or stab-resistant material in the back-of-the-hand region and the outer layer may be made of a textile material in the front-of-the-hand region.

FIGS. 2 to 7 show a first embodiment of the invention. This first embodiment describes a waterproof glove, in which the wearer can choose between the functions of insulation against cold and great tactility of the fingers.

Figure 2:
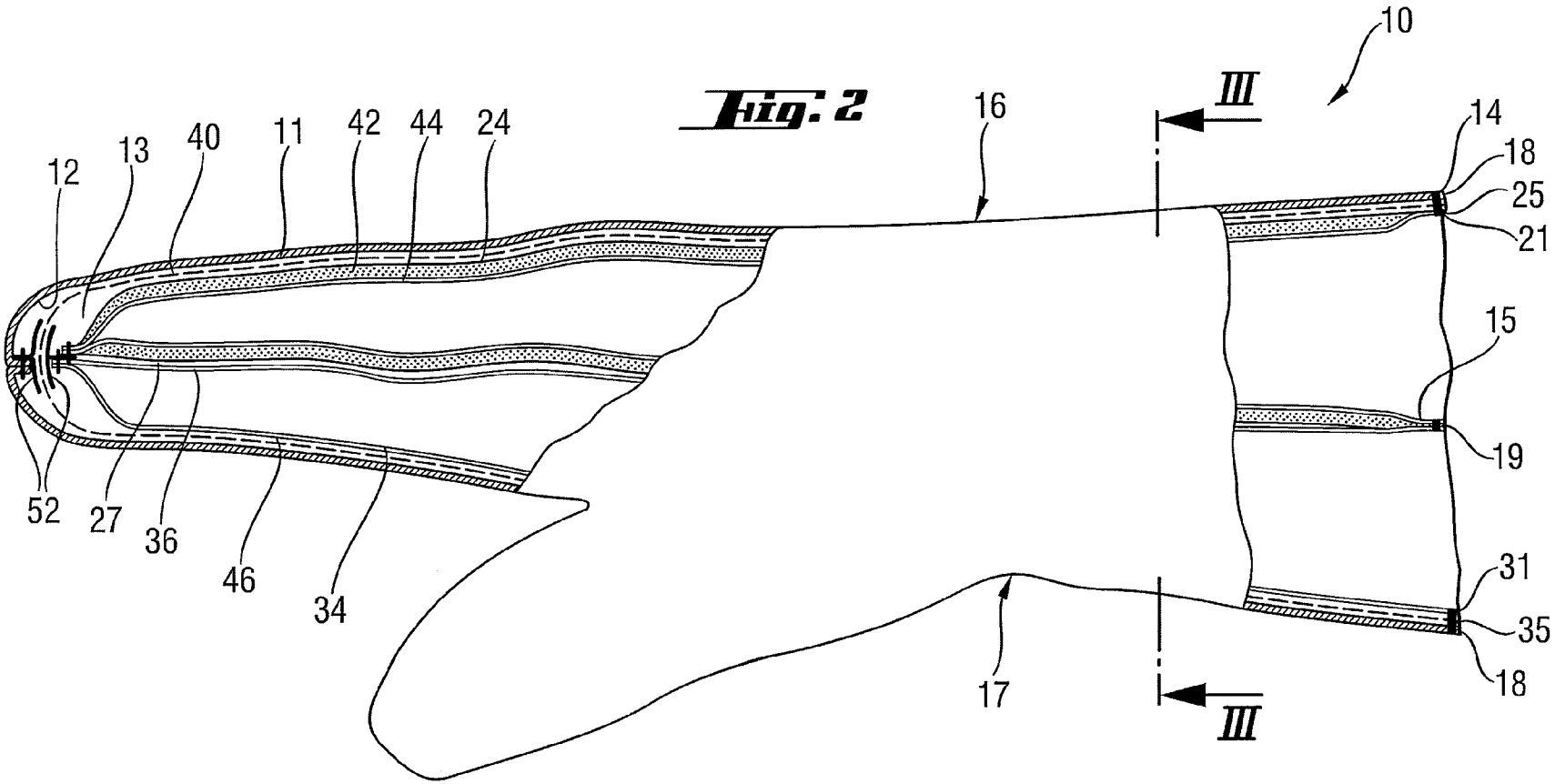
FIG. 2 shows a partial longitudinal section along the line II-II in FIG. 1 in a first embodiment.

FIG. 2 shows a partial longitudinal section along the line II-II in FIG. 1 with the additional material layers of this first embodiment. The glove 10 has an outer layer 11, which encloses an inner space 13. The outer layer 11 has a liquid-impermeable protective material layer in the form of a glove insert 40, which completely covers the inner surface 12 of the outer layer 11. The liquid-impermeable insert 40 may be attached to the outer layer 11 by means of joining tabs 52, which are fastened in a waterproof manner to the tips of the fingers and thumb of the insert 40. For this purpose, the joining tabs 52 may be sewn to the tips of the fingers and thumb of the outer material 11. Furthermore, the hand opening of the insert 40 is joined to the inner space opening 14. As an alternative to this, the insert 40 may also be at least partly adhesively bonded to the inner surface 12 of the outer layer 11, for example by means of a discontinuous adhesive layer.

The inner space 13 is divided along its longitudinal axis into two chambers by means of a first inner glove 24 and a second inner glove 34. Both inner gloves 24, 34 are respectively dimensioned in such a way that they are only a little smaller than the inner space 13, and consequently each inner glove can in itself fill the inner space 13. The two inner gloves 24, 34 are arranged adjacently in the inner space 13 along the longitudinal axis of the inner space and parallel to one another. Each inner glove in itself is in the shape of the inner space. Consequently, the inner gloves extend from the tips of the fingers to the inner space opening 14 and the respective inner glove openings lie next to one another and are incorporated in the inner space opening 14.

The first chamber is located in the back-of-the-hand region 16 and has the first inner glove 24. The first inner glove 24 is produced from the first chamber material and has a first protective material layer 45*a* of an insulating material 42, which is joined to a textile lining layer 44. The insulating layer 42 and the lining layer 44 may be adhesively bonded to one another, for example by means of a discontinuous or water-vapor-permeable continuous adhesive layer, which is arranged between the layers. The two layers may similarly be joined to one another merely by means of a joining seam running along the periphery of the inner glove. The insulating layer 42 is made of a porous insulating material, such as for example absorbent cotton. Instead of the porous insulating material, the inflatable insulating construction may also be provided. The thickness of the insulating layer 42 may be chosen according to the desired insulating performance. In addition to the insulating layer, further protective material layers may also be provided for the first chamber.

To form the inner glove 24, two layers of the first chamber material are placed one on top of the other and joined to one another, for example by means of adhesive bonding or sewing, along the peripheral form of a mitten or finger glove. Subsequently, the inner glove is cut out or punched out along this peripheral seam. The textile lining layer 44 is directed into the interior of the first chamber and gives the wearer a pleasant wearing feel.

The second chamber is located in the front-of-the-hand region 17 and has the second inner glove 34. The second inner glove 34 consists of the second chamber material and has a textile layer 46. Instead of the textile layer 46, at least one second protective material layer may also be provided. In a further configuration, the textile layer 46 is combined with the second protective material layer in the form of a very thin insulating layer.

Both inner gloves 24, 34 respectively have a back-of-the-hand region 26, 36 and a front-of-the-hand region 27, 37. The respective layers, adjacent one another, of the back-of-the-hand and front-of-the-hand regions of the two inner gloves 24, 34 form a common chamber wall, the flexible material layer 15. The back-of-the-hand and the front-of-the-hand region of the inner gloves are preferably joined to one another. The joining may take place either over the full surface area by continuous or discontinuous adhesive bonding or partly in the opening region and in the fingertip region of the inner gloves, preferably by sewing or adhesive bonding. On condition that the first inner glove 24 is directed toward the back-of-the-hand region 16 of the glove 10 and the second inner glove 34 is directed toward the front-of-the-hand region 17 of the glove 10, the material layer 15 is consequently formed by the back-of-the-hand region 26 of the second inner glove 34 and the front-of-the-hand region 27 of the first inner glove 24.

The first inner glove 24 and the second inner glove 34 are arranged in the inner space 13 and within the insert 40. In this case, the front-of-the-hand region 27 of the first inner glove 24 and the back-of-the-hand region 36 of the second inner glove 34 lie one on top of the other and form the flexible material layer 15, which divides the inner space 13 in cross section and along the longitudinal axis into the two functional chambers.

The joining of the front-of-the-hand region 27 of the first inner glove 24 and the back-of-the-hand region 36 of the second inner glove 34 may take place for example by joining the tips of the fingers and the tips of the thumbs of the inner gloves 24, 34 by means of joining tabs 52 and joining the edges of the inner glove openings in the edge region 14 of the flexible material layer 15. According to a further configuration, the front-of-the-hand region 27 and the back-of-the-hand region 36 may be at least partly adhesively bonded to one another.

FIG. 2 shows a possible way of fastening the inner gloves 24, 34, the insert 40 and the outer layer 11 to one another. The waterproof insert 40 is provided at the tips of its fingers and at the tip of the thumb with joining tabs 52, a joining tab being fastened, for example by adhesive bonding or welding, to the insert at each fingertip and at the thumb respectively on the inside and outside, part of the joining tab remaining unfastened for fastening purposes. It is important that the liquid-impermeable insert is not damaged and as a result loses the liquid impermeability. On the unfastened parts of the inner joining tabs, the respective tips of the fingers and thumbs of the first inner glove 24 and of the second inner glove 34 are fastened, preferably by sewing. The unfastened parts of the outer joining tabs are sewn to the outer layer 11.

The inner glove openings of the first inner glove 24 and of the second inner glove 34 respectively form the first chamber opening 21 and the second chamber opening 31, which are arranged within the inner space opening 14. The edges 25, 35 of the inner glove 24, 34 are joined, preferably sewn, to the edge 18 of the inner space opening. However, this only applies to the edge regions that do not belong to the flexible material layer 15. The layers of the flexible material layer 15 are preferably sewn to one another in their edge region 19. Consequently, the edge region 25 of the first inner glove in the back-of-the-hand region is joined, preferably sewn, to the corresponding edge 18 of the inner space opening and the edge region 35 of the second inner glove 34 in the front-of-the-hand region is joined, preferably sewn, to the corresponding edge 18 of the inner space opening.

The flexible material layer 15 is freely movable within the cross section of the inner space 13 between the back-of-the-hand region 16 and the front-of-the-hand region 17 along the longitudinal axis. If the hand 8 is in the first inner glove 24, the flexible material layer 15 lies with the compressed second inner glove 34 in the front-of-the-hand region 17, if the hand 8 is in the second inner glove 34, the flexible material layer 15 lies with the compressed first inner glove 24 in the back-of-the-hand region 16.

Figure 3:
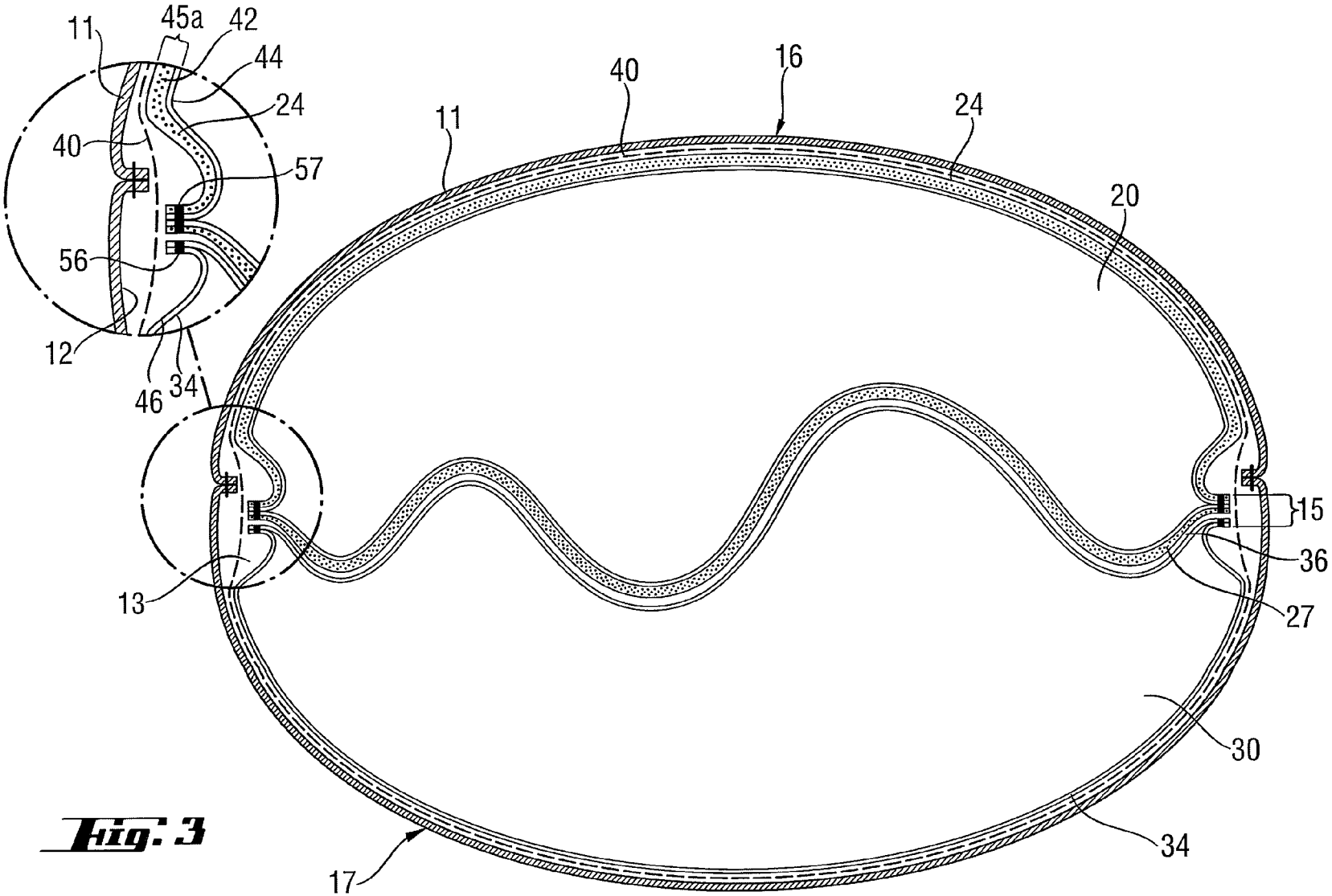
FIG. 3 shows a cross section along the line III-III in FIG. 1 in a first embodiment.

FIG. 3 shows a cross section along the line III-III in FIG. 1 in the first embodiment, without a hand in one of the inner gloves 24, 34. The flexible material layer 15 is formed by the front-of-the-hand region 27 of the first inner glove 24 and the back-of-the-hand region 36 of the second inner glove 34. The material layer 15 is provided movably and with adequate dimensions in the inner space 13, so that it can be pressed by a hand either into the back-of-the-hand region 16 or into the front-of-the-hand region 17. The enlarged detail of a peripheral region of the cross section shows, from the outside inward, the outer layer 11, which is formed by means of a seam 54 into the outer glove, and the insert 40, which covers the inner surface 12 of the outer layer 11. The first inner glove 24 has a peripheral seam 57, which joins the first chamber material to the inner glove. The second inner glove 34 is formed by means of the peripheral seam 56. The first chamber material has a first protective material layer 45*a*, which has an insulating material layer 42 and a textile lining layer 44. The first and second inner gloves 24, 34 are arranged within the insert 40 and fill the inner space 13.

FIG. 4 shows a partial longitudinal section according to FIG. 2 with a hand 8 in the first. inner glove 24, that is to say in a first user situation. As a result, the entire hand 8 is surrounded by insulating material 42, and consequently protected against cold. The liquid-impermeable insert 40 additionally provides protection at least against the ingress of water. The second inner glove 34 is pressed flat in the region of the front-of-the-hand region 17.

Figure 5:
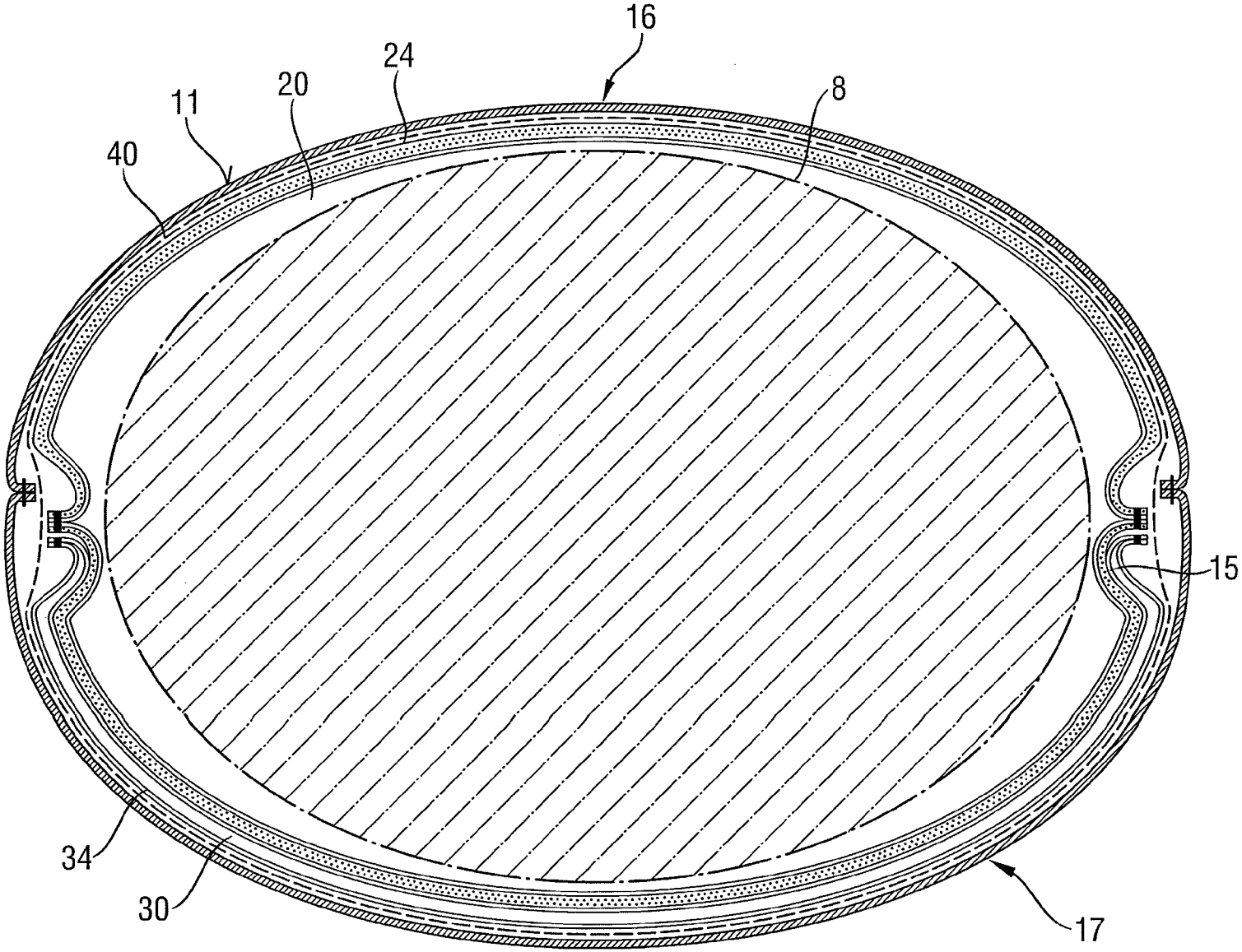
FIG. 5 shows a cross section along the line V-V in FIG. 4 with a hand in a first application situation.

FIG. 5 shows a cross section along the line V-V in FIG. 4, with a hand 8 in the first inner glove 24. This cross section was taken at the wrist; the same cross-sectional construction is obtained in the region of the thumb or fingers of the glove. The fact that the hand 8 is in the first inner glove 24 means that the second inner glove 34 is compressed in the front-of-the-hand region 17 of the glove 10. The waterproof insert 40 encloses both the first inner glove 24 and the second inner glove 34.

Figure 6:
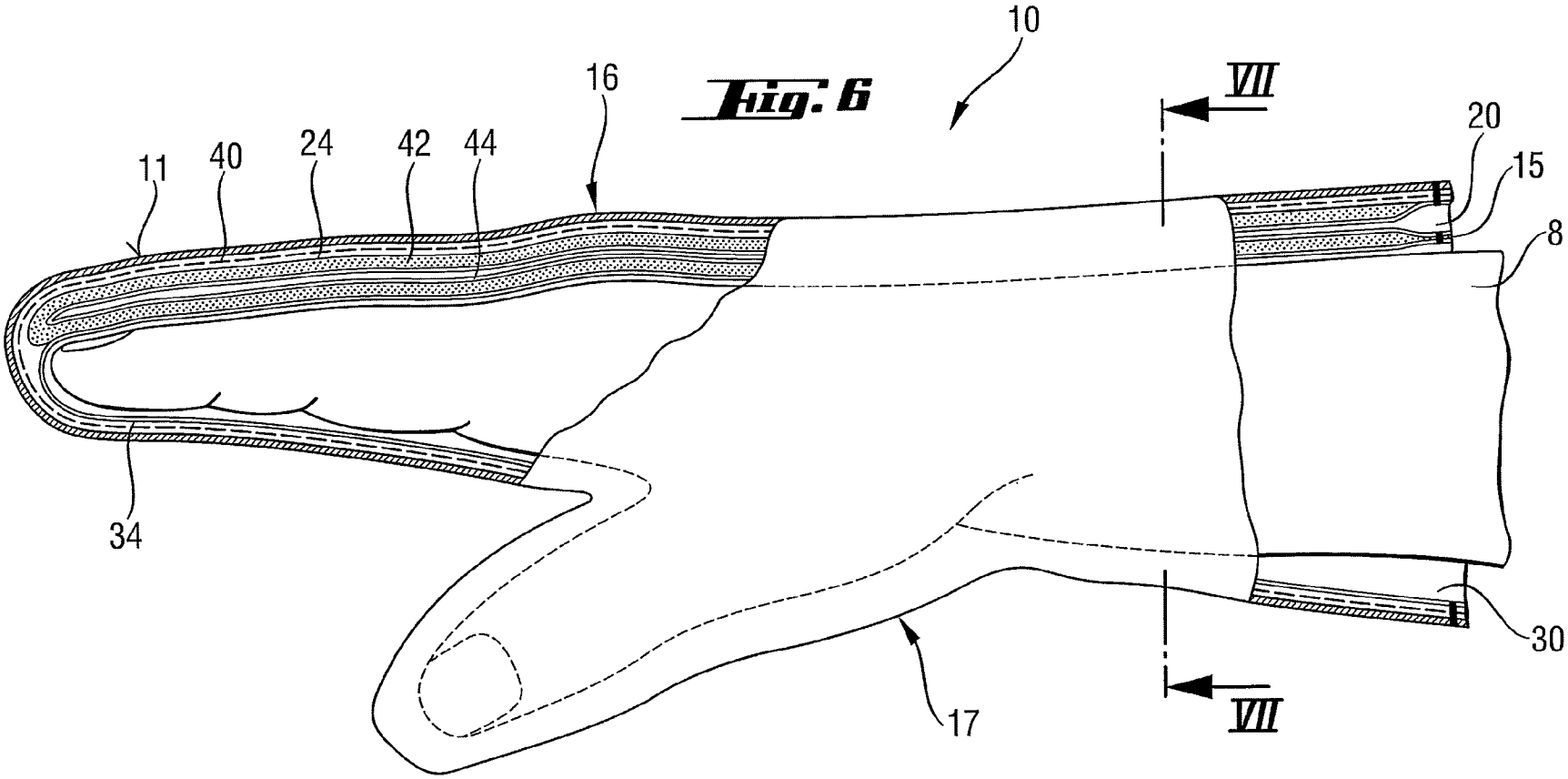
FIG. 6 shows a partial longitudinal section according to FIG. 2 with a hand in a second application situation.

FIG. 6 schematically shows a partial longitudinal section according to FIG. 2. The glove corresponds in its construction to the glove in FIG. 2, with the difference that the hand 8 is in the second inner glove 34, consequently in a second user situation. The first inner glove 24 is compressed, so that the entire assembly comprising the insulating layer 42 and the textile lining layer 44 lies in the back-of-the-hand region 16 of the glove 10. Consequently, around ¾ of the surrounding area of the fingers and of the hand is without insulation and merely surrounded by the textile layer 46 of the second inner glove 34, the insert 40 and the outer layer 11. There is consequently no longer the thick insulating layer 42, impeding the dexterity of the fingers, and the fingers have adequate freedom of movement for gripping movements. In addition, the fingers experience a certain cooling, since they only have an insulating material in the back-of-the-hand region.

Figure 7:
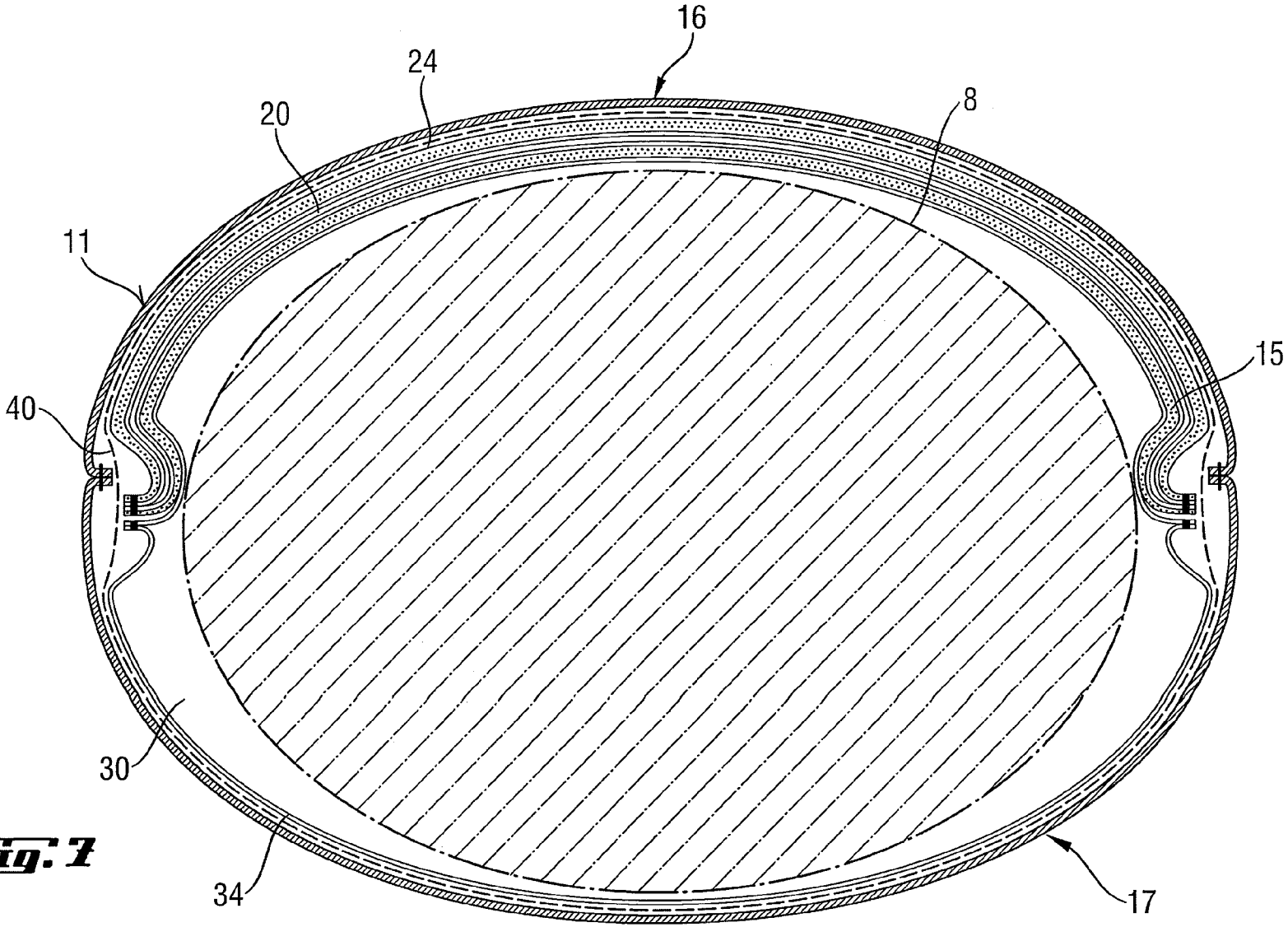
FIG. 7 shows a cross section along the line VII-VII in FIG. 6 with a hand in a second application situation.

FIG. 7 shows a cross section along the line VII-VII in FIG. 6 through the glove 10 in FIG. 7, the hand 8 being inserted in the second inner glove 34 and, accordingly, the first inner glove 24 being arranged such that it is compressed in the back-of-the-hand region 16 of the glove 10. Consequently, the thicker layers, which tend to hinder the tactility of a hand, are arranged in the back-of-the-hand region 16, allowing the fingers of the hand to be moved well in the front-of-the-hand region 17.

FIGS. 8 to 11 are schematic representations of a second possible embodiment of the invention. In the case of this embodiment, the wearer has the choice between a protective function and the function of great tactility or great freedom of movement of the fingers. The protective function may be diverse and comprises, individually or in combination, protection against water and/or wind and/or hazardous foreign substances, protection against stabs and/or cuts, protection against heat or cold. For example, the glove 10 may be a motorcycle glove. For the wearer of the motorcycle glove, great tactility of the fingers while riding or while handling the motorcycle is of importance. In special situations, however, protection from the weather, in particular the waterproofness of the gloves, is most important.

Figure 8:
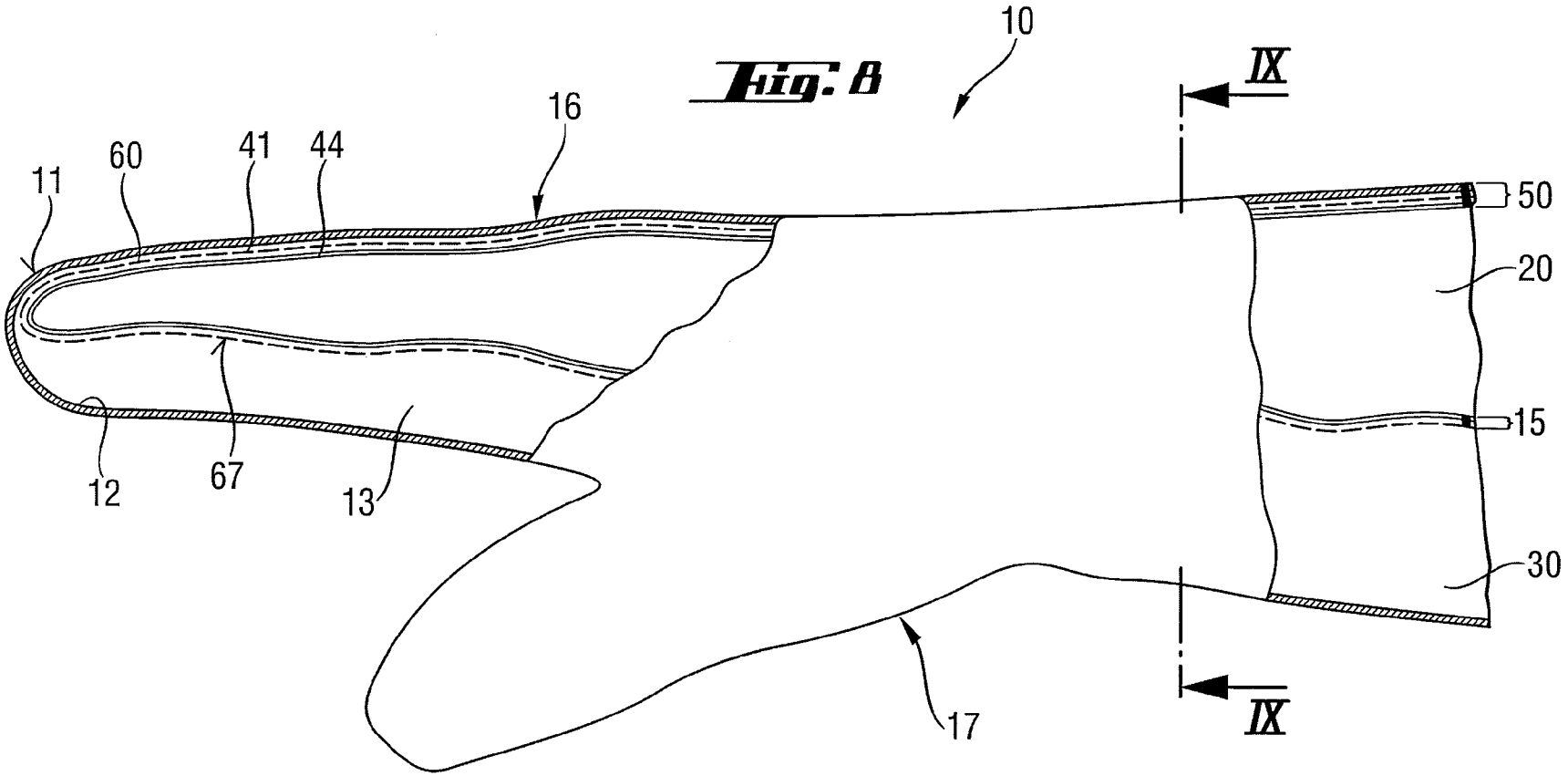
FIG. 8 shows a partial longitudinal section according to FIG. 2 in a second embodiment.
Figure 4:
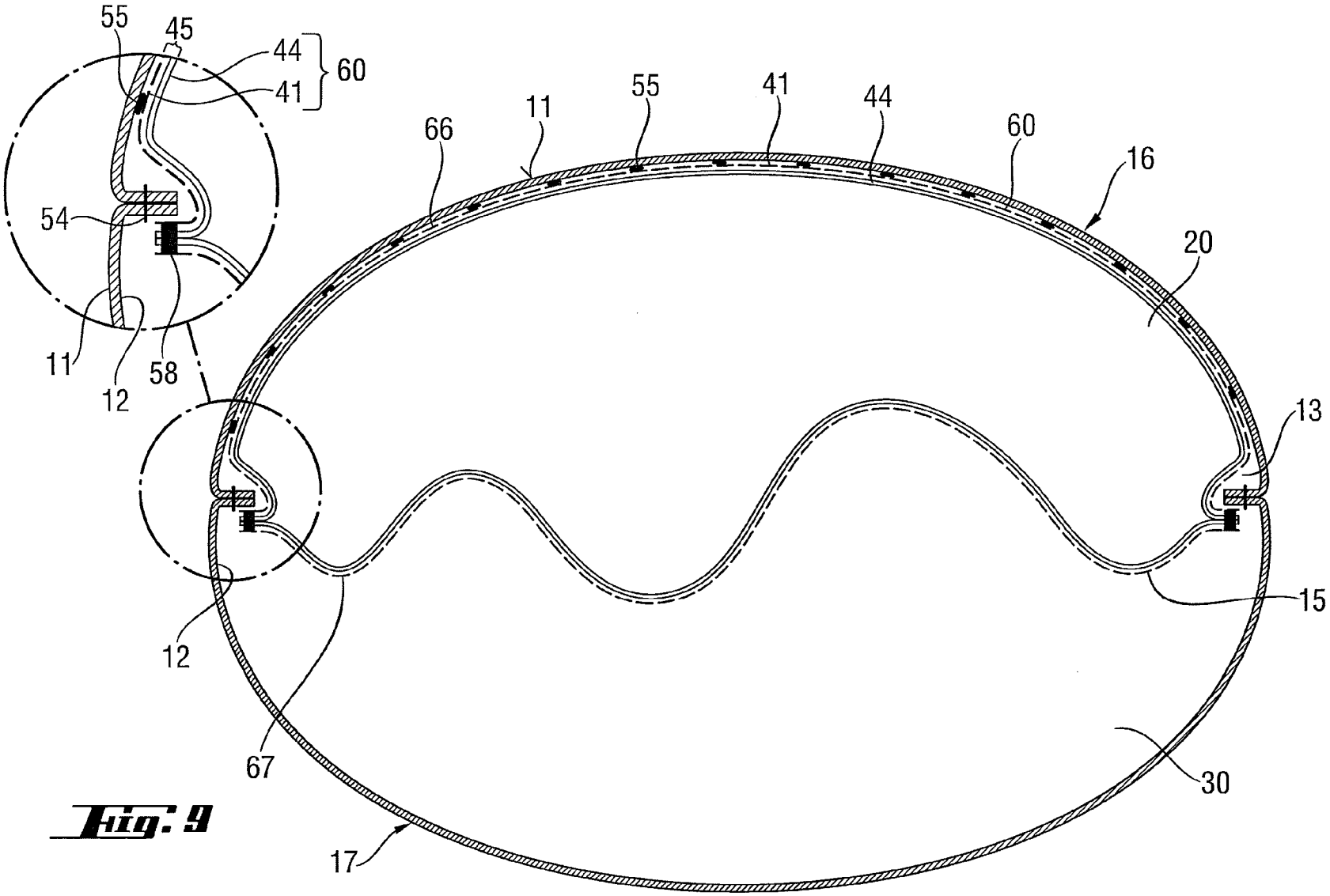

FIG. 8 shows a partial longitudinal section according to FIG. 2 with the additional material layers of this second embodiment. The glove 10 has an outer layer 11, preferably made of leather. Here, too, the glove 10 has a first chamber 20 and a second chamber 30, which are formed by the flexible material layer 15, which centrally divides the cross section of the inner space 13 in the direction of the longitudinal axis of the latter. The first chamber 20 is assigned to the back-of-the-hand region 16 and the second chamber 30 is assigned to the front-of-the-hand region 17. The first chamber 20 is formed by a liquid-impermeable inner glove 60, the second chamber 30 is formed by the inner surface 12 of the outer layer 11 and the front-of-the-hand region 67 of the inner glove 60. The front-of-the-hand region 67 of the inner glove 60 at the same time represents the flexible material layer 15. The inner glove 60 comprises the first chamber material and has at least one liquid-impermeable laminate 50 as the protective material layer. Laminate 50 has at least one liquid-impermeable, preferably waterproof, functional layer 41, which is joined to at least one textile lining layer 44. The functional layer may additionally be windproof and water-vapor-permeable. Preferably, a waterproof, windproof and water-vapor-permeable membrane is used. In one embodiment, the laminate 50 has a waterproof and water-vapor-permeable, microporous membrane of expanded polytetrafluoroethylene (ePTFE), which is preferably provided on one surface with a continuous layer of polyurethane and a lining material laminated on top. An inner glove 60 comprising such a laminate is obtainable for example from the company W.L. Gore & Associates GmbH, Putzbrunn, Del. Such an inner glove 60 protects the wearer in particular from water.

Apart from the liquid-impermeable laminate, the first chamber material may have further protective material layers. For example, the liquid-impermeable laminate may be provided with an insulating layer, or has a layer of a cut-resistant material.

The inner glove 60 may be adhesively bonded in a punctiform manner to the back-of-the-hand region 16 of the glove 10; an adhesive applied in lattice form or continuously may also be used instead. It must be ensured here that only the back-of-the-hand region 1 of the inner glove 60 is joined to the outer layer 11, in order that the second chamber 30 can be created. In particular, only approximately half of the edge of the inner glove 60 is joined to the edge of the inner space opening, as a result of which the front-of-the-hand region 67 of the inner glove 60 forms the flexible material layer 15 between the first chamber 20 and the second chamber 30.

As described in relation to FIG. 2, the inner glove 60 may also be fastened by means of joining tabs at the tips of the fingers and at the tip of the thumb of the glove. In this case, the peripheral edge of the inner glove 60 is additionally joined to the edge of the outer layer 11 around the outer periphery. In a way similar to the adhesively bonded solution, the edge of the inner glove 60 is joined to the edge of the inner space opening in the back-of-the-hand region 1 of the inner glove 60, as a result of which the front-of-the-hand region 67 forms the flexible material layer 15 between the first chamber 20 and the second chamber 30.

FIG. 9 shows the cross section along the line IX-IX in FIG. 8. The front-of-the-hand region 67 of the inner glove 60 forms the flexible material layer 15 between the two chambers 20, 30. The back-of-the-hand region 66 of the inner glove 60 is fastened to the inner surface 12 of the outer layer 11 by means of a discontinuous adhesive layer 55. The enlarged detail of a peripheral region in FIG. 9 shows the way in which these layers are put together in this portion. The outer layer 11 is joined by means of the seam 54.

The inner glove 60 has a protective material layer 45, which contains a laminate 50 of a liquid-impermeable functional layer 41 and a textile lining layer 44. The inner glove 60 is formed by means of an adhesive seam 58. The back-of-the-hand region 66 of the inner glove is fixed to the outer layer 11 by means of a discontinuous adhesive layer.

Figure 10:
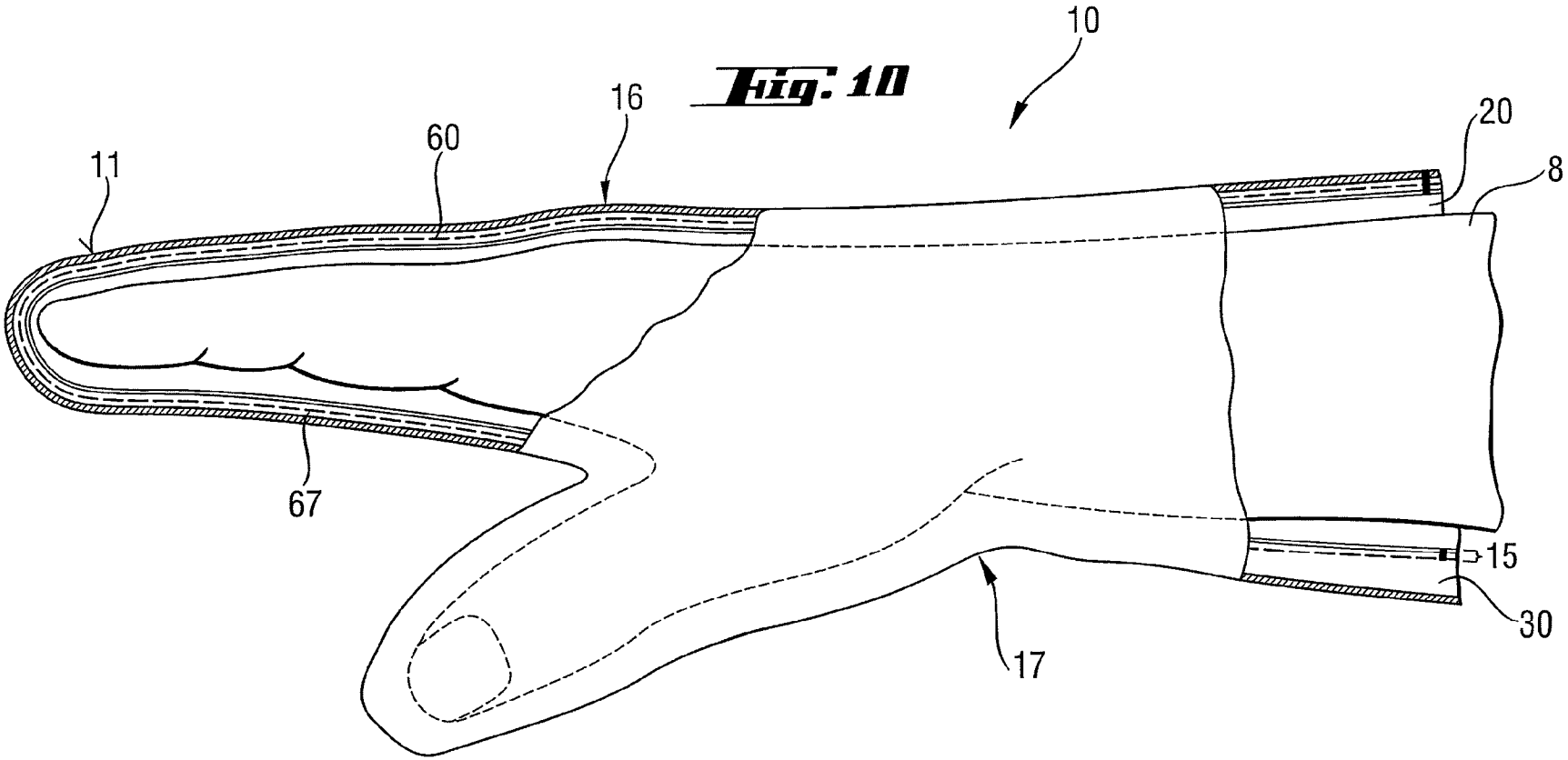
FIG. 10 shows a partial longitudinal section according to FIG. 8 with a hand in a first application situation.

FIG. 10 shows a partial longitudinal section according to FIG. 8 with a hand 8 in the first chamber 20. The hand 8 is in the liquid-impermeable inner glove 60, and consequently in the first chamber 20. The second chamber 30 is compressed and the front-of-the-hand region 67 of the inner glove 60 is in the front-of-the-hand region 17 of the outer layer 11.

Figure 11:
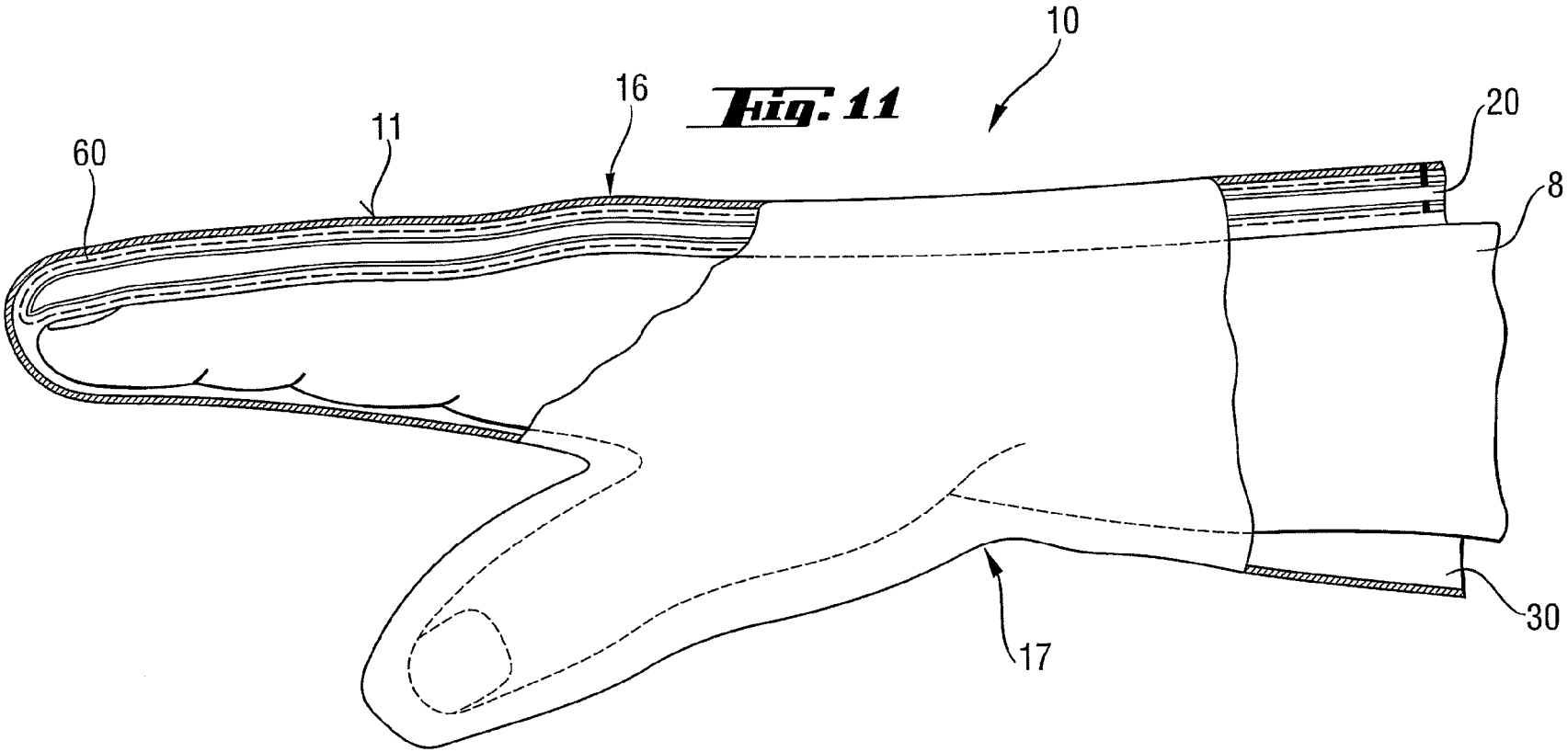
FIG. 11 shows a partial longitudinal section according to FIG. 8 with a hand in a second application situation.

FIG. 11 shows a partial longitudinal section according to FIG. 8 with a hand 8 in the second chamber 30. The first chamber 20, and consequently the entire inner glove 60, is compressed in the back-of-the-hand region 16 of the glove 10. Consequently, merely the outer layer 11 covers the underside of the hand 8 and the wearer of the glove has great tactility of his fingers in this region. Manual actions, for example when riding a motorcycle, can be reliably carried out.

FIG. 12 shows an inner glove 24, 34, 60, 40 which, according to the present invention, is used to form the first chamber 20 or second chamber 30 in the inner space 13 of an outer layer 11 or, as a glove insert 40, covers the inner surface 12 of the outer layer 11. Preferably, laminates are used, having a liquid-impermeable functional layer and at least one textile layer. It is also possible to use the laminates without a textile layer.

The inner glove has a first material layer 80 and a second material layer 85. The first material layer and the second material layer may both comprise the first chamber material or the second chamber material. They may, however, also comprise a different material. The first material layer and the second material layer are joined to one another along the desired peripheral edge by suitable joining means, thereby forming a seam 56, 57, 58. The inner glove is produced by two opposite material layers of the same construction being placed one on top of the other in such a way that the opposite sides are made of the same material. Preferably, this seam is waterproof. An opening is provided, in order to receive the hand of the wearer. Examples of suitable joining means are sewing, adhesive bonding, high-frequency sealing, welding such as ultrasonic welding, microwave welding and heat sealing. In one embodiment, the seam is formed by means of a suitable adhesive, such as for example polyurethane adhesive, hotmelt adhesive or reactive hotmelt adhesive.

FIG. 13 shows a section along the line XIII-XIII in FIG. 12. This section shows an embodiment of the first and second material layers 80, 85. The first and second material layers 80, 85 each have a protective material layer 45, which is joined to a textile lining layer 44. The protective material layer 45 and the lining layer 44 may lie loosely one on top of the other and be joined to one another only by means of the peripheral seal of the inner glove. They may also be joined to one another over their surface area by means of a continuously or discontinuously applied adhesive layer. If breathable material layers are desired, the adhesive layer must be either a breathable continuous adhesive or a discontinuous adhesive. A breathable adhesive indicates a hydrophilic adhesive. A breathable hydrophilic adhesive has a high water vapor transmission and brings about good adhesive bonding between the layers. Examples of breathable adhesives include polyether-polyurethane and moisture-curing polyether-polyurethanes. The adhesive layer may if necessary also contain fillers.

The discontinuous adhesive may either be breathable or non-breathable. The application of the discontinuous adhesive may take place either on the protective material layer 50 or the lining layer. Application methods comprise for example lattice printing, gravure printing, spraying and all other methods that are known in the prior art.

The protective material layer comprises different materials, depending on the desired protective function.

To form the inner glove, the protective material layer 50 and the textile lining layer 44 are joined to one another by means of a seam 57 along the desired glove periphery.

FIG. 14 shows a section along the line XIII-XIII in FIG. 12 in a further embodiment. The first material layer 80 and the second material layer 85 are respectively formed by a waterproof 3-ply laminate. The 3-ply laminate comprises a waterproof and water-vapor-permeable ePTFE membrane 48, which is arranged between two textile layers 44, 46. The joining of the layers to one another preferably takes place by means of a discontinuous adhesive layer. The two material layers 80, 85 are joined to the inner glove in a waterproof manner by means of an adhesive seam 58.

EXAMPLES

Example 1

A garment according to the invention is produced in the form of a ski glove.

An outer glove is produced from a number of glove parts (cut-to-size pieces). The outer glove comprises an upper hand part, an inner hand part and finger side parts lying between the fingers. The parts are sewn to one another. The upper hand part and the finger side parts consist of polyester with a weight per unit area of 120 g/m$^2$. The inner hand part consists of the same textile material as the upper hand part; in the region of the underside of the fingers and the palm of the hand, leather may also be used instead of the textile material. The outer side of the outer glove is rendered hydrophobic with water repellent.

A liquid-impermeable glove insert is produced. For this, a two-ply textile laminate comprising a liquid-impermeable functional layer and a textile layer is produced. The functional layer is a microporous expanded polytetrafluoroethylene (ePTFE) membrane, which has a water-vapor-permeable non-porous polyurethane coating according to U.S. Pat. No. 4,194,041. The functional layer is laminated on one side with a textile layer by using a plurality of adhesive points of a polyurethane adhesive. The textile layer is produced from polypropylene. The laminate has a weight of 50-60 g/m$^2$ (according to ISO 9073-1).

The insert is formed by placing two textile laminates one on top of the other and joining them to one another in a waterproof manner along the contour of a glove. For this purpose, a bead of adhesive is applied to the textile layer of a laminate. The bead of adhesive is laid in the form of the outer periphery of the glove insert. The adhesive is a reactive polyurethane hotmelt adhesive. The second laminate is placed onto the first laminate, the textile layers lying one on top of the other. The two laminates are pressed together, thereby forcing the adhesive through the textile layers to the functional layer and joining the two laminates to one another. After that, the finished glove insert is punched out by a punch in the form of a hand. The glove insert is waterproof and water-vapor-permeable. Such glove inserts are obtainable from W.L. Gore & Associates GmbH, Feldkirchen.

A first chamber is produced in the form of a first inner glove. For this purpose, two layers of an insulating material are provided. The insulating material is Thinsulate® with a weight per unit area of 40 g/m$^2$ and is obtainable from the company 3M. On one surface, the insulating material is provided with a textile lining layer of brushed polyester with a weight per unit area of 90 g/m$^2$. Two layers of the insulating material are placed one on top of the other, so that the lining layers lie one on top of the other. Subsequently, the layers are sewn to one another to form a glove, which is only slightly smaller in its dimensions than the outer glove.

A second chamber is produced in the form of a second inner glove. For this purpose, a glove which is only slightly smaller in its dimensions than the outer glove is sewn from a textile lining material of brushed polyester and with a weight per unit area of 90 g/m$^2$.

To complete the glove according to the invention, firstly the two inner gloves are joined to one another. For this, adhesive strips are respectively sewn on as joining tabs at the tips of the fingers and tips of the thumbs of both inner gloves. The adhesive strips are narrow textile material strips, which have an adhesive coating on one surface. A commercially available heat-resistant adhesive may be used as the adhesive coating, preferably a thermally activatable adhesive. The adhesive strips of the two inner gloves are sewn to one another at the same fingers respectively. Subsequently, the first inner glove and the second inner glove lie one on top of the other, so that the edges of the lining material of the second inner glove and of the insulating material of the first inner glove that lie one on top of the other can be sewn in the opening region. This completes the flexible material layer.

The glove insert is turned onto its left side, so that the textile lining layer is facing outward. The glove insert is joined to the two inner gloves, in that the adhesive strips are adhesively attached at the tips of the fingers and thumbs to the corresponding tips of the fingers and tip of the thumb of the insert. For this purpose, the adhesive strips are placed onto the respective tip of a finger and, by briefly applying pressure and heat, the adhesive coating penetrates through the textile material to the functional layer and joins the adhesive strips to the insert. Subsequently, the insert is turned back again onto its right side, whereby the two inner gloves order themselves inside the insert in such a way that they are adjacent and parallel to one another. In the edge region of the insert opening, the still loose edges of the inner gloves can be sewn to the edge of the insert.

For the finished glove, the insert is fastened to the inner gloves lying inside the outer glove. For this purpose, further adhesive strips are fastened at the tips of the fingers and the tip of the thumb of the insert by briefly applying pressure and heat. The outer glove is turned onto its left side and the tips of its fingers and the tip of its thumb are sewn to the free ends of the adhesive strips of the inserts. Subsequently, the outer glove is turned back onto its right side, so that the insert with the two inner gloves is inside it. As the final step, the edge of the outer glove opening is sewn in such a way that the edge of the insert is neatly enclosed by the outer edges of the inner gloves.

Example 2

A garment according to the invention is produced in the form of a motorcycle glove.

An outer glove is produced as described in Example 1, with the difference that leather is exclusively used as the material. The leather material has a thickness of 0.6 mm.

As the first chamber, a glove insert is produced as described in Example 1.

Subsequently, the glove insert is fastened in the outer glove as the first chamber. For this purpose, the outer surface of the insert is provided with an adhesive layer in the back-of-the-hand region. The adhesive layer is a layer of polyurethane in the form of a lattice and is melted on the surface by means of a release paper. The insert is drawn onto a heatable mold, which is constructed in the form of a hand, so that the insert lies taut and without folds on the mold. The outer glove is drawn over the insert and lies taut and without folds over the insert. In the back-of-the-hand region, the adhesive layer lies between the inner surface of the outer glove and the surface of the insert. The mold is heated to ≥110° C., whereby the adhesive melts and joins the two layers in the back-of-the-hand region. After 20 seconds, the glove is pulled off the mold. As the final step, the edge of the outer glove is sewn to the associated edge of the insert in the back-of-the-hand region, so that the edge in the front-of-the-hand region of the insert remains freely movable inside the glove.

The invention claimed is:

1. A glove comprising:

an outer layer (11) enclosing an inner space (13) having at least one opening, the inner space (13) being divided into at least two adjacent chambers (20, 30) which are arranged parallel to one another in the inner space (13), the first chamber (20) having a first chamber opening (21) and the second chamber (30) having a second chamber opening (31), the first and second chamber openings (21, 31) being arranged next to one another within the opening (14) of the inner space (13), and the chamber openings (21, 31) filling the inner space opening (14), and the first chamber (20) being formed by a first inner glove (24) and the second chamber (30) being formed by a second inner glove (34), with the first and second inner gloves (24, 34) being arranged within the outer layer (11), said first inner glove (24) and said second inner glove (34) being configured to receive a hand, wherein the first chamber (20) has a first chamber material comprising a first protective material layer (45) and a first functional layer material and the second chamber (30) has a second chamber material comprising at least one second protective material, wherein said first chamber (20) and said second chamber (30) have the shape of said inner space (13), wherein the first functional layer material is liquid-impermeable and water-vapor permeable, and wherein the cross section of the inner space (13) is divided in the direction of its longitudinal axis into the at least two adjacent chambers (20, 30) by means of at least one flexible material layer (15), and one side of the first or second inner glove forms the flexible material layer.

2. The glove as claimed in claim 1, the inner space opening (14) having an inner space edge (18).

3. The glove as claimed in claim 1, at least one chamber being joined to the outer layer.

4. The glove as claimed in claim 1, the at least two chambers (20, 30) being joined to one another.

5. The glove as claimed in claim 1, the first inner glove (24) and the second inner glove (34) being joined to one another and fastened to the outer layer (11).

6. The glove as claimed in claim 1, the first inner glove (24) having a first chamber material and the second inner glove (34) having the second chamber material (34).

7. The glove as claimed in claim 6, the first chamber material being different from the second chamber material.

8. The glove as claimed in claim 1, the functional layer material being windproof.

9. The glove as claimed in claim 1, the functional layer material having a barrier layer against chemical and biological toxicants.

10. The glove as claimed in claim 1, the barrier layer having at least one adsorption layer based on an adsorbent adsorbing chemical toxicants.

11. The glove as claimed in claim 1, the barrier layer having at least one liquid-impermeable, air-impermeable and water-vapor-permeable membrane.

12. The glove as claimed in claim 1, the barrier layer having at least one liquid-impermeable, air-impermeable and water-vapor-permeable membrane and at least one adsorption layer based on an adsorbent adsorbing chemical toxicants.

13. The glove as claimed in claim 1, the functional layer material having a microporous polymeric membrane.

14. The glove as claimed in claim 13, the membrane comprising expanded polytetrafluoroethylene.

15. The glove as claimed in claim 1, the first chamber material having a first protective material layer in the form of a layer of at least one insulating material.

16. The glove as claimed in claim 1, the first functional layer material having at least one insulating material.

17. The glove as claimed in claim 1, the first chamber material having a first protective material layer in the form of a layer of at least one cut-resistant material.

18. The glove as claimed in claim 1, the second chamber material having a layer of textile material.

19. The glove as claimed in claim 1, the second chamber material having a second protective material layer in the form of a layer of at least one insulating material.

20. The glove as claimed in claim 1, the second chamber material having a second protective material layer in the form of a layer of at least one functional layer material.

21. The glove (10) as claimed in claim 1, the first functional layer material being liquid-impermeable.

22. The glove (10) as claimed in claim 1, the first functional layer material being water-vapor-permeable.

23. The glove (10) as claimed in claim 1, the first functional layer material being windproof.

24. The glove (10) as claimed in claim 1, the first functional layer material having a barrier layer against chemical and biological toxicants.

25. The glove (10) as claimed in claim 24, the barrier layer having at least one adsorption layer based on an adsorbent adsorbing chemical toxicants.

26. The glove (10) as claimed in claim 24, the barrier layer having at least one liquid-impermeable, air-impermeable and water-vapor-permeable membrane.

27. The glove (10) as claimed in claim 24, the barrier layer having at least one liquid-impermeable, air-impermeable and water-vapor-permeable membrane and at least one adsorption layer based on an adsorbent adsorbing chemical toxicants.

28. The glove (10) as claimed in claim 1, the functional layer material having a microporous polymeric membrane.

29. The glove (10) as claimed in claim 28, the membrane comprising expanded polytetrafluoroethylene.

30. The glove as claimed in claim 1, wherein said second chamber provides tactility.

31. A waterproof glove (10) comprising:

an outer layer (11) enclosing an inner space (13) with at least one opening (14), the inner space (13) being divided into at least two adjacent chambers (20, 30) which are arranged parallel to one another in the inner space (13), said first chamber (20) having a first chamber opening (21) and said second chamber (30) having a second chamber opening (31), the first and second chamber openings (21, 31) being arranged next to one another within the opening (14) of the inner space (13), and the chamber openings (21, 31) filling the inner space opening (14), wherein the first chamber (20) has at least one first function and the second chamber (30) has at least one different second function, wherein said first chamber (20) and said second chamber (30) have the shape of the inner space (13), wherein the cross section of the inner space (13) is divided in the direction of its longitudinal axis into the first and second chambers (20, 30) by at least one flexible material layer (15), wherein an area of the flexible material layer (15) is at least half an inner area of the inner space (13), wherein the first chamber (20) is formed by a first inner glove (24) and the flexible material layer (15), wherein said first inner glove (24) is configured to receive a hand (8), and wherein the outer layer (11) has an outer layer material having a layer of a liquid-impermeable functional layer material.

32. The glove (10) as claimed in claim 31, with a back-of-the-hand region (16) and a front-of-the-hand region (17), the inner space (13) being divided into the first chamber (20) and the second chamber (30), adjacent the first chamber (20) in such a way that the first chamber (20) is arranged between the back-of-the-hand region (16) and the second chamber (30) and the second chamber (30) is arranged between the first chamber (20) and the front-of-the-hand region (17).

33. The glove (10) as claimed in claim 31, the first and second inner gloves (24, 34) being joined to the outer layer (11).

34. The glove (10) as claimed in claim 31, the inner gloves (24, 34) being fastened to one another and to the outer layer (11).

35. The glove (10) as claimed in claim 31, the outer layer (11) having at least one outer layer material.

36. The glove (10) as claimed in claim 35, the outer layer material having a third protective material layer in the form of a layer of at least one heat-resistant and/or flame-retardant material.

37. The glove (10) as claimed in claim 35, the outer layer material having a third protective material layer in the form of a layer of at least one liquid-impermeable functional layer material.

38. The glove (10) as claimed in claim 35, the outer layer material having a third protective material layer in the form of a layer of at least one cut-resistant material.

39. The glove (10) as claimed in claim 31, the first chamber material being different from the second chamber material.

40. The glove (10) as claimed in claim 31, the first chamber material having a first protective material layer in the form of a layer of at least one insulating material.

41. The glove (10) as claimed in claim 31, the first functional layer material having a layer of at least one functional layer material.

42. The glove (10) as claimed in claim 31, the first chamber material having a first protective material layer in the form of a layer of at least one cut-resistant material.

43. The glove (10) as claimed in claim 31, the second chamber material having a layer of textile material.

44. The glove (10) as claimed in claim 31, the second chamber material having a second protective material layer in the form of a layer of at least one insulating material.

45. The glove (10) as claimed in claim 31, the second chamber material having a second protective material layer in the form of a layer of at least one functional layer material.

46. The glove (10) as claimed in claim 31, with a back-of-the-hand region (16) and a front-of-the-hand region (17), the inner space (13) being divided into the first chamber (20) and the second chamber (30) and the chambers being arranged adjacent one another in such a way that the first chamber (20) is arranged between the back-of-the-hand region (16) and the second chamber (30) and the second chamber (30) is arranged between the first chamber (20) and the front-of-the-hand region (17), the outer layer (11) having an outer layer material with a layer of a liquid-impermeable functional layer material, the first chamber (20) being formed by means of the first inner glove (24) of a first chamber material, the first chamber material having a layer of an insulating material and a layer of textile material and the second chamber (30) being formed by means of the second inner glove (34) of a second chamber material, which has a layer of textile material.

47. The glove (10) as claimed in claim 31, with a back-of-the-hand region (16) and a front-of-the-hand region (17), the inner space (13) being divided into the first chamber (20) and the second chamber (30), the second chamber (30) being adjacent to the first chamber (20) and the chambers (20, 30) being arranged next to one another in such a way that the first chamber (20) is arranged between the back-of-the-hand region (16) and the second chamber (30) and the second chamber (30) is arranged between the first chamber (20) and the front-of-the-hand region (17), the first chamber (20) being formed by means of the first inner glove (24), which has a layer of a liquid-impermeable functional layer material and a layer of a textile material.

48. The glove as claimed in claim 31, wherein at least the first chamber (20) is fastened to the outer layer (11) at tips of fingers of said glove.

49. The glove as claimed in claim 31, wherein said flexible material layer (15) compresses against an inner surface (12) of the outer layer (11) upon insertion of said hand into one of said first inner glove (24) and said second inner glove (34).

50. The glove as claimed in claim 31, wherein said first protective material layer includes a barrier layer having at least one liquid-impermeable, air-impermeable and water-vapor permeable membrane and at least one adsorption layer based on an adsorbent adsorbing chemical toxicants.

51. The glove as claimed in claim 31, wherein said second chamber provides tactility.

* * * * *

UNITED STATES PATENT AND TRADEMARK OFFICE

CERTIFICATE OF CORRECTION

PATENT NO. : 9,066,545 B2
APPLICATION NO. : 11/911839
DATED : June 30, 2015
INVENTOR(S) : Helmut Klug and Mandy Gorlt It is certified that error appears in the above-identified patent and that said Letters Patent is hereby corrected as shown below:

Specification

At column 3, line 27, change “an” to --a--

At column 3, line 28, change “chemically” to --chemical--

At column 3, line 38, change “chemically” to --chemical--

At column 5, line 58, change “on” to --or--

At column 16, line 28, change “U.S. Pat. No. 4,2340,838” to --U.S. Pat. No. 4,230,838--

At column 21, line 50, change “Del.” to --Germany--

Signed and Sealed this
Eighth Day of March, 2016

Michelle K. Lee

Michelle K. Lee
*Director of the United States Patent and Trademark Office*